US010345062B2

(12) United States Patent
Alexander et al.

(10) Patent No.: US 10,345,062 B2
(45) Date of Patent: Jul. 9, 2019

(54) SEMI-AUTOMATIC SHOTGUN AND COMPONENTS THEREOF

(71) Applicant: Savage Arms, Inc., Westfield, MA (US)

(72) Inventors: Aaron K. Alexander, Westfield, MA (US); John Linscott, Easthampton, MA (US)

(73) Assignee: Savage Arms, Inc., Westfield, MA (US)

( * ) Notice: Subject to any disclaimer, the term of this patent is extended or adjusted under 35 U.S.C. 154(b) by 0 days.

(21) Appl. No.: 15/847,822

(22) Filed: Dec. 19, 2017

(65) Prior Publication Data

US 2018/0172376 A1 Jun. 21, 2018

Related U.S. Application Data

(60) Provisional application No. 62/436,346, filed on Dec. 19, 2016.

(51) Int. Cl.
*F41A 5/28* (2006.01)
*F41A 9/72* (2006.01)

(52) U.S. Cl.
CPC . *F41A 5/28* (2013.01); *F41A 9/72* (2013.01)

(58) Field of Classification Search
CPC ..... F41A 5/18; F41A 5/26; F41A 5/28; F41A 9/72
USPC ..... 89/191.01, 191.02, 193
See application file for complete search history.

(56) References Cited

U.S. PATENT DOCUMENTS 3,020,807 A * 2/1962 Hailston ..... F41A 5/28 89/193
3,127,812 A * 4/1964 Into ..... F41A 5/28 89/193
3,657,960 A * 4/1972 Badali ..... F41A 5/18 89/191.02
3,968,727 A * 7/1976 Hyytinen ..... F41A 5/28 89/191.02
3,990,348 A * 11/1976 Vesamaa ..... F41A 5/28 89/193
4,102,242 A 7/1978 Liedke
4,601,122 A 7/1986 Beretta
4,702,146 A 10/1987 Ikeda et al.
4,856,217 A 8/1989 Benelli
4,872,392 A 10/1989 Powers et al.
(Continued)

*Primary Examiner* — Jonathan C Weber
(74) *Attorney, Agent, or Firm* — Christensen, Fonder, Dardi & Herbert PLLC

(57) ABSTRACT

A semiautomatic shotgun comprising a receiver, a barrel, a forward gas block assembly attached to the barrel, a slider assembly rearward of the gas block assembly extending into the receiver. Upon firing a shotshell the explosive gases in the barrel are diverted through two ports into the gas block assembly, specifically into a pair of lateral pressure relief valves positioned on both sides of the barrel. The pressure relief valves further having a gas pathway to a piston chamber. A piston is forced rearwardly and engages a slider of the slider assembly that is linked to a breech block in the receiver. The breech block loads unfired shells and ejects the fired shells accomplishing the semiautomatic recycling. The dual pressure relief valves actuate to moderate and limit the gas pressure that enters the piston chamber when using shotshells of different power levels thereby providing consistency in the recycling operation.

17 Claims, 30 Drawing Sheets

(56) References Cited

U.S. PATENT DOCUMENTS

| | | | | |
|---|---|---|---|---|
| 4,901,623 | A | 2/1990 | Lee | |
| 5,218,163 | A * | 6/1993 | Dabrowski | F41A 5/26 89/193 |
| 5,429,034 | A | 7/1995 | Badali et al. | |
| 5,867,928 | A | 2/1999 | Plebani | |
| 5,872,323 | A | 2/1999 | Norton et al. | |
| 5,918,401 | A | 7/1999 | Rowlands | |
| 5,959,234 | A | 9/1999 | Scaramucci et al. | |
| 6,347,569 | B1 | 2/2002 | Butler | |
| 6,382,073 | B1 | 5/2002 | Beretta | |
| 6,470,614 | B1 | 10/2002 | Johnson | |
| 6,508,160 | B2 | 1/2003 | Beretta | |
| 6,564,691 | B2 | 5/2003 | Butler | |
| 6,619,592 | B2 | 9/2003 | Vignaroli et al. | |
| 7,467,581 | B2 | 12/2008 | Botty | |
| 7,775,149 | B2 | 8/2010 | Keeney et al. | |
| 7,946,214 | B2 | 5/2011 | Stone | |
| 7,963,061 | B2 | 6/2011 | Lesenfants | |
| 8,056,280 | B2 | 11/2011 | Lesenfants et al. | |
| 8,065,949 | B1 | 11/2011 | Molinari | |
| 8,079,168 | B2 | 12/2011 | Lesenfants | |
| 8,109,194 | B2 | 2/2012 | Stone | |
| 8,230,632 | B2 | 7/2012 | Moretti | |
| 8,245,625 | B2 | 8/2012 | Winge | |
| 8,250,964 | B2 | 8/2012 | Stone | |
| 8,312,656 | B2 | 11/2012 | Lesenfants | |
| 8,443,712 | B2 | 5/2013 | Molinari | |
| 8,528,458 | B2 | 9/2013 | Windauer | |
| 8,850,731 | B2 | 10/2014 | Botty et al. | |
| 8,939,060 | B2 | 1/2015 | Bassoli et al. | |
| 9,097,475 | B2 | 8/2015 | Ricks | |
| 9,212,856 | B2 | 12/2015 | Baker | |
| 9,383,149 | B2 | 7/2016 | Ricks | |
| 9,816,768 | B2 * | 11/2017 | Ricks | F41A 5/22 |
| 2005/0257681 | A1 * | 11/2005 | Keeney | F41A 5/18 89/129.01 |
| 2011/0271826 | A1 | 11/2011 | Molinari | |
| 2014/0096674 | A1 | 4/2014 | Bassoli et al. | |
| 2016/0084597 | A1 | 3/2016 | Ricks | |

* cited by examiner

SEMI-AUTOMATIC SHOTGUN AND COMPONENTS THEREOF

CROSS-REFERENCE TO RELATED APPLICATIONS

The present application claims the benefit of U.S. Provisional Patent Application No. 62/436,346, filed Dec. 19, 2016, which is hereby incorporated by reference in its entirety.

BACKGROUND OF THE DISCLOSURE

Shotguns of any particular gauge may fire different shotshell cartridges with different payloads and propellant loads. With pump action shotguns the recycling occurs after the firing of the shotshell cartridges and occurs manually. Thus, there is no relation of the type of propellant load to the recycling reliability of the shotgun. In semiautomatic shotguns, the recycling occurs by bleeding off propellant gas from the barrel to actuate a piston connected to the breech block. The reliability of the cycling can be affected by the type of shotshell cartridge fired as well as the usable life of the shotgun. That is, a shotgun that reliably cycles for a magnum round that produces higher barrel pressures might not cycle for a lower powered skeet round with lower barrel pressures. And a shotgun that cycles for both a lower powered skeet round and a magnum powered round may subject the cycle mechanism components to higher forces causing premature failure of components. Improvement in versatility and reliability of semiautomatic shotguns when used with different powered shotshell cartridges would be welcome.

SUMMARY

A semiautomatic shotgun, the shotgun comprising a barrel, a cycling piston in a cylinder defining a piston chamber below the barrel, the barrel having a propellant gas diversion from a pair of ports in the barrel, through a pair of first gas passageways, into a pair of lateral chambers positioned on both sides of the barrel, each of the chambers having pressure relief valves therein. The chambers each further having a second gas passageways to the piston chamber for recycling the shotgun.

In embodiments, the second gas passageways is offset and nonlinear with the first gas pathway. The lateral chambers each having a cross sectional area greater than the first gas passageways and greater than the second gas passageways.

Embodiments of the shotgun provide a balanced reliable gas diversion system offering consistent cycling operation with different powered shotshell cartridges without the need for adjustment of the pressure relief valves.

In one or more embodiments, a semiautomatic shotgun comprises a receiver defining a receiver interior and a barrel attached to a forward portion of the receiver. The barrel has a barrel wall defining a barrel bore extending along a barrel axis of the barrel. The barrel wall defines a firing chamber that is dimensioned and configured to receiving a shell. A breech block is slidably received in the receiver interior. The breech block is movable between a forward position in which the breech block engages the breech end of the barrel for firing a chambered shell and a rearward position in which the breech block contacts a plunger of a spring loaded plunger assembly. In one or more embodiments, the spring loaded plunger assembly comprises the plunger, a first plunger spring, and a second plunger spring. In one or more embodiments, the first plunger spring defines a spring lumen and the second plunger spring is disposed inside the spring lumen defined by the first plunger spring. In one or more embodiments, a return spring 142 provides a return force urging the breech block toward the forward position. In one or more embodiments, a gas operated mechanism is disposed about the magazine tube and the gas operated mechanism comprises an annular shaped piston. In one or more embodiments, combustion gasses apply pressure to a forward facing surface of the annular shaped piston, the pressure applied to the annular shaped piston creates a rearward force, and the rearward force urges the breech block toward the rearward position. In one or more embodiments, a slider is disposed about the magazine tube at a location rearward of the annular shaped piston. In one or more embodiments, a port leg and a starboard leg extend between the slider and the breach block. In one or more embodiments, combustion gasses apply pressure to a forward facing surface of the annular shaped piston, the pressure applied to the annular shaped piston creates a rearward force, and the rearward force is transferred to the breech block by the sleeve, the starboard leg and the port leg.

In one or more embodiments, a semiautomatic shotgun comprises a receiver defining a receiver interior and a breech block that is slidably received in the receiver interior. The breech block is movable between a forward position in which the breech block engages the breech end of the barrel for firing a chambered shell and a rearward position in which the breech block is positioned rearward of the breech end of the barrel for discharging a spent shell. A barrel and a magazine tube extend forwardly from a forward portion of the receiver. The barrel has a breech end and a muzzle end. A barrel wall of the barrel extends between the breech end and the muzzle end. The barrel wall defines a barrel bore extending along a barrel axis of the barrel. The barrel wall defines a firing chamber and barrel bore, the firing chamber being dimensioned and configured to receiving a shell. The magazine tube has a rearward end and a forward end. A magazine wall of the magazine tube extends between the rearward end and the forward end. The magazine wall defines a magazine tube bore extending along a magazine axis of the magazine tube. The barrel axis and the magazine axis are parallel and define a vertical plane.

A semiautomatic shotgun in accordance with the embodiments described in the preceding paragraph may further include a gas block assembly including a gas block that is disposed about the magazine tube with the magazine tube extending through the block bore defined by the gas block. The gas block assembly includes a starboard regulator assembly and a port regulator assembly. The gas block defines a starboard regulator cavity and a port regulator cavity. The starboard regulator cavity extends along a starboard regulator axis and the port regulator cavity extends along a port regulator axis. The starboard regulator axis and the port regulator axis define a horizontal plane. In one or more embodiments, the horizontal plane defined by the starboard regulator axis and the port regulator axis is perpendicular to the vertical plane defined by the barrel axis and the magazine axis. In one or more embodiments, the starboard regulator assembly and the starboard regulator cavity are disposed starboard of the vertical plane defined by the barrel axis and the magazine axis. In one or more embodiments, the starboard regulator assembly and the starboard regulator cavity are disposed below the barrel axis and above the magazine axis. In one or more embodiments, the port regulator assembly and the port regulator cavity are disposed portward of the vertical plane defined by the barrel axis and the magazine axis. In one or more embodiments, the port regulator assembly and the port regulator cavity are disposed below the barrel axis and above the magazine axis.

A semiautomatic shotgun in accordance with the embodiments described in the preceding paragraph may further include a sleeve comprising a sleeve wall extending into the block bore defined by a gas block with a portion of the sleeve disposed between an outer surface of the magazine tube and inner surface of the gas block. In one or more embodiments, the magazine tube, the sleeve, and the gas block cooperate to define an annular volume. The annular volume communicates with the barrel bore so that combustion gasses can enter the annular volume. The starboard regulator assembly acts to release combustion gasses when the combustion gasses in the barrel bore and/or the annular volume reaches a first predetermined pressure. The port regulator assembly acts to release combustion gasses when the combustion gasses in the barrel bore and/or the annular volume reaches a first predetermined pressure. In one or more embodiments, the first predetermined pressure and the second predetermined pressure are different. In one or more embodiments, the first predetermined pressure is selected to correspond to a first shotshell load and the second predetermined pressure is selected to correspond to a second shotshell load. In one or more embodiments, the first predetermined pressure and the second predetermined pressure are substantially equal. In one or more embodiments, the first predetermined pressure and the second predetermined pressure have values within about ten percent of one another.

A semiautomatic shotgun in accordance with one or more embodiments comprises a receiver, a barrel and a magazine tube. The barrel and the magazine tube both extend forward beyond a forward end of the receiver with the magazine tube being located below the barrel. In an embodiment, a gas operated mechanism is disposed about the magazine tube. In an embodiment, the gas operated mechanism comprises a gas block assembly that including an annular shaped piston. In an embodiment, the annular shaped piston extends into a block bore defined by a gas block of the gas block assembly. In an embodiment, the block bore extends along a block bore axis. In an embodiment, the gas block assembly includes a starboard regulator housing defining starboard regulator cavity that extends along a starboard regulator axis. In an embodiment, the starboard regulator housing comprises a first starboard male thread and the first starboard male thread is disposed in threaded engagement with a first starboard female thread of the gas block. In an embodiment, a starboard valve member is disposed in the starboard regulator cavity with a seating surface of the starboard valve member is biased to seat against a complementary surface of the starboard regulator housing by a starboard spring. In an embodiment, a forward end of the starboard spring seats against the starboard valve member and a rearward end of the starboard spring seats against a starboard retainer. In an embodiment, the starboard retainer comprises a second starboard male thread and the second starboard male thread is disposed in threaded engagement with a second starboard female thread of the starboard regulator housing. In an embodiment, the gas block assembly includes a port regulator housing defining port regulator cavity that extends along a port regulator axis. In an embodiment, the port regulator housing comprises a first port male thread and the first port male thread is disposed in threaded engagement with a first port female thread of the gas block. In an embodiment, a port valve member is disposed in the port regulator cavity with a seating surface of the port valve member is biased to seat against a complementary surface of the port regulator housing by a port spring. In an embodiment, a forward end of the port spring seats against the port valve member and a rearward end of the port spring seats against a port retainer. In an embodiment, the port retainer comprises a second port male thread and the second port male thread is disposed in threaded engagement with a second port female thread of the port regulator housing. In an embodiment, the starboard regulator axis, the port regulator axis, and the block bore axis define a triangular prism comprising a first base, a second base and three side faces. In an embodiment, the starboard regulator axis and the block bore axis define a first plane and a first side face of the triangular prism lies in the first plane. In an embodiment, the port regulator axis and the block bore axis define a second plane and a second side face of the triangular prism lies in the second plane. In an embodiment, the starboard regulator axis and the port regulator axis define a third plane and a third side face of the triangular prism lies in the third plane.

A semiautomatic shotgun in accordance with one or more embodiments comprises a receiver defining a receiver interior and a barrel attached to a forward portion of the receiver. The barrel has a breech end and a muzzle end. A barrel wall of the barrel extends between the breech end and the muzzle end. The barrel wall defines a barrel bore extending along a longitudinal axis of the barrel. The barrel wall defines a firing chamber with the barrel bore, the firing chamber being dimensioned and configured to receiving a shell.

In one or more embodiments, a breech block is slidably received in the receiver interior. The breech block is movable between a forward position in which the breech block engages the breech end of the barrel for firing a chambered shell and a rearward position in which the breech block is positioned rearward of the breech end of the barrel for discharging a spent shell. A magazine tube is attached to a forward portion of the receiver. The magazine tube has a rearward end and a forward end. A magazine wall of the magazine tube extends between the rearward end and the forward end. The magazine wall defines a magazine tube bore extending along a longitudinal axis of the magazine tube.

In one or more embodiments, the semiautomatic shotgun includes a sleeve having a circular or tubular shape and comprising a sleeve wall. The sleeve wall having an outer surface and an inner surface. The inner surface of the sleeve wall defining a lumen. The sleeve is positioned so that the sleeve wall encircles the magazine tube with the magazine tube extending through the lumen. The sleeve has a rearward end and a forward end. A first sealing ring is disposed between the inner surface of the sleeve and an outer surface of the magazine tube. In embodiments addition sealing rings may be placed between the inner surface of the sleeve and an outer surface of the magazine tube. One or more second sealing rings may be disposed between the outer surface of the sleeve and an inner facing bore surface of the gas block. The space between the inner facing surface of the gas block and the outer surface of the magazine tube defining an annular expansion chamber and the sleeve defining an annular piston.

In one or more embodiments, the gas block defines a channel and an upward facing opening fluidly communicating with the channel. The barrel extends into the channel. In one or more embodiments, the gas block is fixed to the barrel. The gas block has a rearward end and a forward end. The gas block has a body extending in a forward direction from the rearward end to the forward end and extending in a rearward direction from the forward end to the rearward end. The body of the gas block defines a pair of chambers, a starboard regulator cavity and a port regulator cavity.

In one or more embodiments, the starboard regulator cavity comprises a forward starboard bore, a rearward starboard bore and a starboard step or shoulder defining a valve seat between the forward starboard bore and the rearward starboard bore. The forward starboard bore extends in the forward direction away from the starboard valve seat. The starboard rearward bore extends in the rearward direction away from the starboard valve seat. The forward starboard bore is defined by a forward bore surface of the gas block. The rearward starboard bore is defined by a rearward bore surface. The starboard valve seat comprises a starboard valve seat surface extending between the forward starboard bore surface and the starboard rearward bore surface. The forward starboard bore has a first diameter, the starboard rearward bore has a second diameter. In one or more embodiments, the second diameter is greater than the first diameter. The forward starboard bore surface meets the starboard valve seat surface at an edge. A starboard valve member is disposed in the starboard regulator cavity. A seating surface of the starboard valve member is biased to seat against the edge by a starboard spring. A starboard guide extends through a lumen defined by the starboard spring and into a starboard pocket defined by the starboard valve member.

In one or more embodiments, the starboard forward bore of the starboard regulator cavity fluidly communicates with the barrel bore via a starboard passageway defined by the gas block and a starboard hole defined by the barrel. The forward starboard bore of the starboard regulator cavity fluidly communicates with the annular volume via a starboard aperture. Upon firing a shell with the shotgun, combustion gasses within the barrel enter the annular volume via the starboard hole and the port hole to move the sleeve and a slider rearward for cycling a mechanism disposed in the receiver interior.

In one or more embodiments, the semiautomatic shotgun includes a slider comprising a slider wall. The slider wall has an outer surface and an inner surface with the inner surface defining a lumen. The slider is positioned so that the slider wall encircles the magazine tube and the magazine tube extends through the lumen. The slider having a rearward end and a forward end. The slider wall extends between the rearward end and the forward end. A slider assembly includes the slider and a starboard leg having a forward end and a rearward end. A portion of the starboard leg proximate the forward end is fixed to the slider. A portion of the starboard leg proximate the rearward end engages the mechanism disposed inside the receiver interior. The slider assembly also includes a port leg having a forward end and a rearward end. A portion of the port leg proximate the forward end is fixed to the slider. A portion of the port leg proximate the rearward end engages the mechanism disposed inside the receiver interior.

A feature and advantage of embodiments of the invention is that the two regulators can be adjusted to have different pressure relief points wherein considering restricted volumetric passages to each, one may release for a certain barrel pressure, for example for a lowered powered cartridge, and the other does not release. And wherein for a higher pressure cartridge, both regulators may release.

A feature and advantage of embodiments is a tandem pair of regulators that operate a different relief pressures.

A feature and advantage of embodiments is a tandem pair of regulators that have different sized volumetrically.

A feature and advantage of embodiments is a tandem pair of regulators that have the same sizes volumetrically and have different spring forces providing different pressure release points.

A feature and advantage of embodiments is a tandem pair of regulators that have the same sizes volumetrically and have different sizes of valve members and valve seats.

A feature and advantage of embodiments is a tandem pair of regulators that operate at the same relief pressure and offer redundancy in operation.

A feature and advantage of embodiments is a semiautomatic shotgun that reliably cycles shotshells of different propellant loads.

A feature and advantage of embodiments is a semiautomatic shotgun with an adjustable pressure relief valve, in embodiments, two adjustable relief valves.

A feature and advantage of embodiments is a semiautomatic shotgun that provides dual pressure relief valves adding reliability, redundancy, and a compact form factor. Moreover, the gas from the propellant is provided to the piston in a more balanced manner than conventional gas operated shotguns.

The above summary is not intended to describe each illustrated embodiment or every implementation of the present disclosure.

BRIEF DESCRIPTION OF THE FIGURES

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1A:
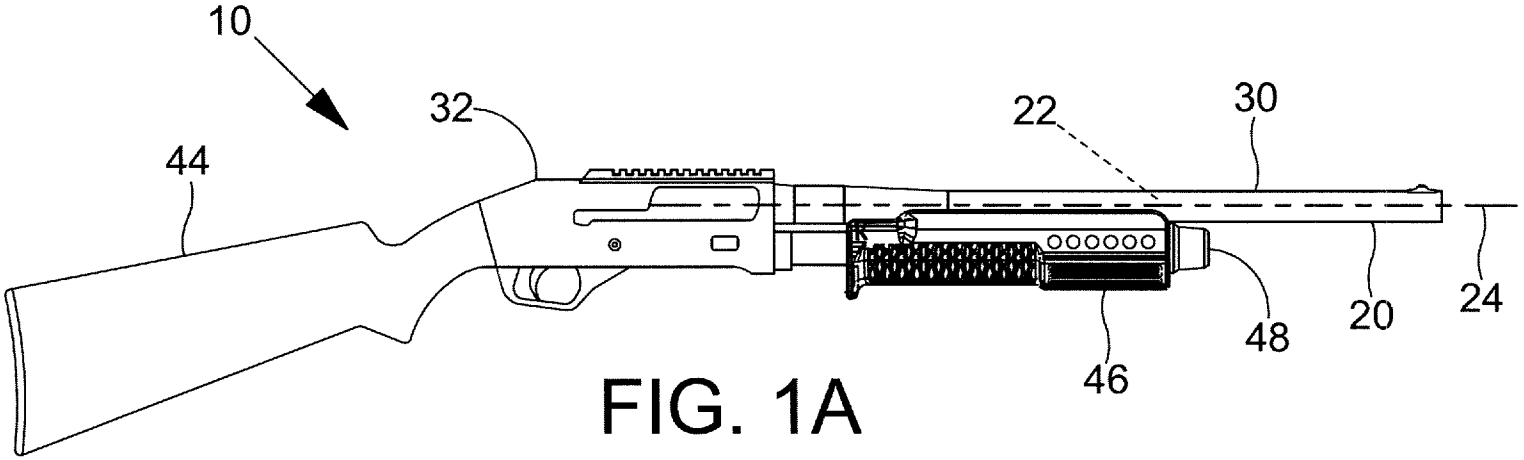
FIG. 1A is a side elevation view showing a shotgun in accordance with an embodiment described in the detailed description.

While embodiments of the disclosure are amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DETAILED DESCRIPTION

Referring, for example, to FIGS. 14-20F, a semiautomatic shotgun 10 in accordance with one or more embodiments comprises a receiver 32 defining a receiver interior 34 and a barrel 20 attached to a forward portion of the receiver 32. The shotgun is particularly suited for firing shotshells 33 of different power levels. The barrel 20 has a barrel wall 30 defining a barrel bore 22 extending along a barrel axis 24 of the barrel 20. The barrel wall 30 defines a firing chamber that is dimensioned and configured to receiving the shells of different power levels. A breech block 38 is slidably received in the receiver interior 34. The breech block 38 is movable between a forward position in which the breech block 38 engages the breech end 28 of the barrel 20 for firing a chambered shell and a rearward position in which the breech block 38 contacts a plunger 52 of a spring loaded plunger assembly 50. In one or more embodiments, the spring loaded plunger assembly 50 comprises the plunger 52, a first coil spring 82, and a second coil spring 84. In one or more embodiments, the first coil spring 82 defines a spring lumen 80 and the second coil spring 84 is disposed inside the spring lumen 80 defined by the first coil spring 82. In one or more embodiments, a return spring provides a return force urging the breech block 38 toward the forward position. In one or more embodiments, a gas operated mechanism 36 is disposed about the magazine tube 120 and the gas operated mechanism 36 comprises an annular shaped piston 250. In one or more embodiments, combustion gasses apply pressure to a forward facing surface of the annular shaped piston 250, the pressure applied to the annular shaped piston creates a rearward force, and the rearward force urges the breech block 38 toward the rearward position. In one or more embodiments, a slider 150 is disposed about the magazine tube 120 at a location rearward of the annular shaped piston 250. In one or more embodiments, a port leg 166 and a starboard leg 164 extend between the slider 150 and the breach block 38. In one or more embodiments, combustion gasses apply pressure to a forward facing surface of the annular shaped piston 250, the pressure applied to the annular shaped piston creates a rearward force, and the rearward force is transferred to the breech block 38 by the sleeve, the starboard leg 164 and the port leg 166.

Referring, for example, to FIGS. 14 and 21-25B a semiautomatic shotgun 10 in accordance with one or more embodiments comprises a receiver 32, a barrel 20 and a magazine tube 120. The barrel 20 and the magazine tube 120 both extend forward beyond a forward end of the receiver 32 with the magazine tube 120 being located below the barrel 20. A gas operated mechanism 36 is disposed about the magazine tube 120. In one or more embodiments, the gas operated mechanism 36 comprises an annular shaped piston 250 and gas block assembly 200. The gas block having a rearward body portion 240 defining a lumen and two forwardly extending tubular extensions comprising a starboard tubular extension 338 and a port tubular extension 438 defining a starboard regulator cavity 322 and a port regulator cavity 422 respectively. In one or more embodiments, the semiautomatic shotgun 10 includes a starboard regulator assembly 320 disposed in the starboard regulator cavity 322 and a port regulator assembly disposed in the port regulator cavity. The semiautomatic shotgun 10 may also include a breech block 38 that is slidably received in the receiver interior 34. In one or more embodiments, the breech block 38 is movable between a forward position in which the breech block 38 engages the breech end 28 of the barrel 20 for firing a chambered shell, and a rearward position in which the breech block 38 contacts a plunger 52 of a spring loaded plunger assembly 50. A rearward force produced by the gas block assembly 200 urges the breech block 38 toward the rearward position.

Figure 1B:
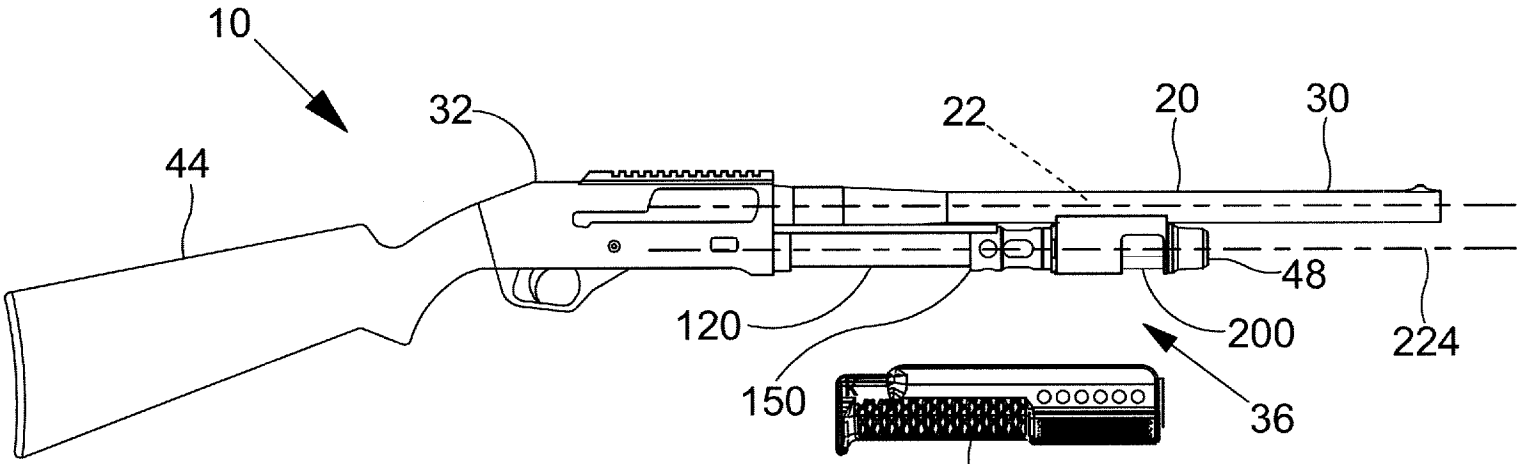
FIG. 1B is a partially exploded side view of the shotgun shown in FIG. 1A.
Figure 2:
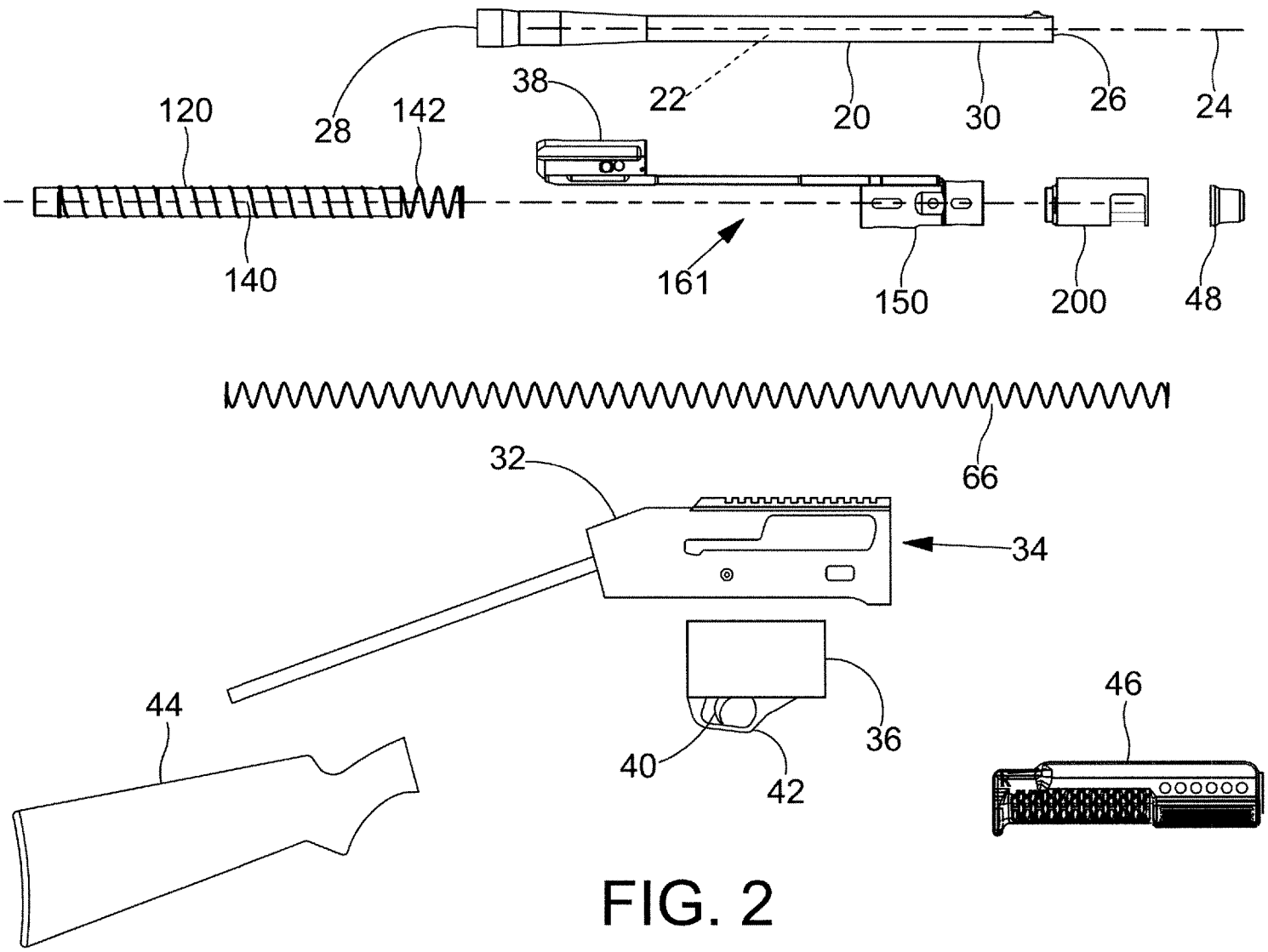
FIG. 2 is an exploded side view of the shotgun shown in FIG. 1A.
Figure 3A:
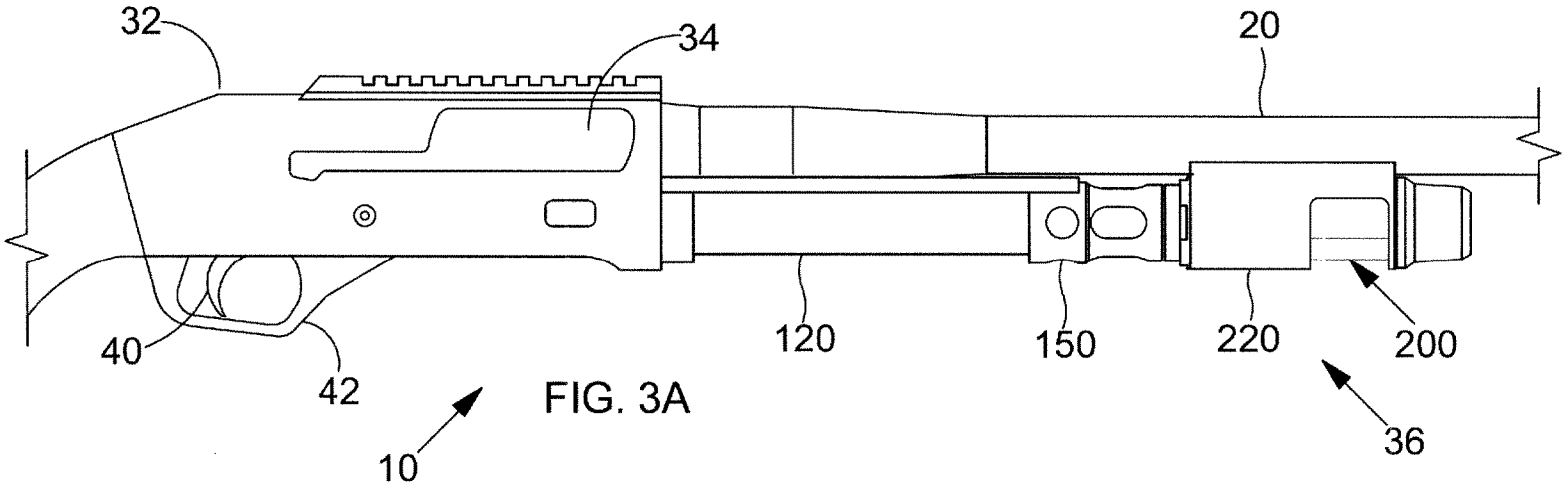
FIG. 3A is an enlarged side view of the shotgun shown in FIG. 1B.
Figure 3B:
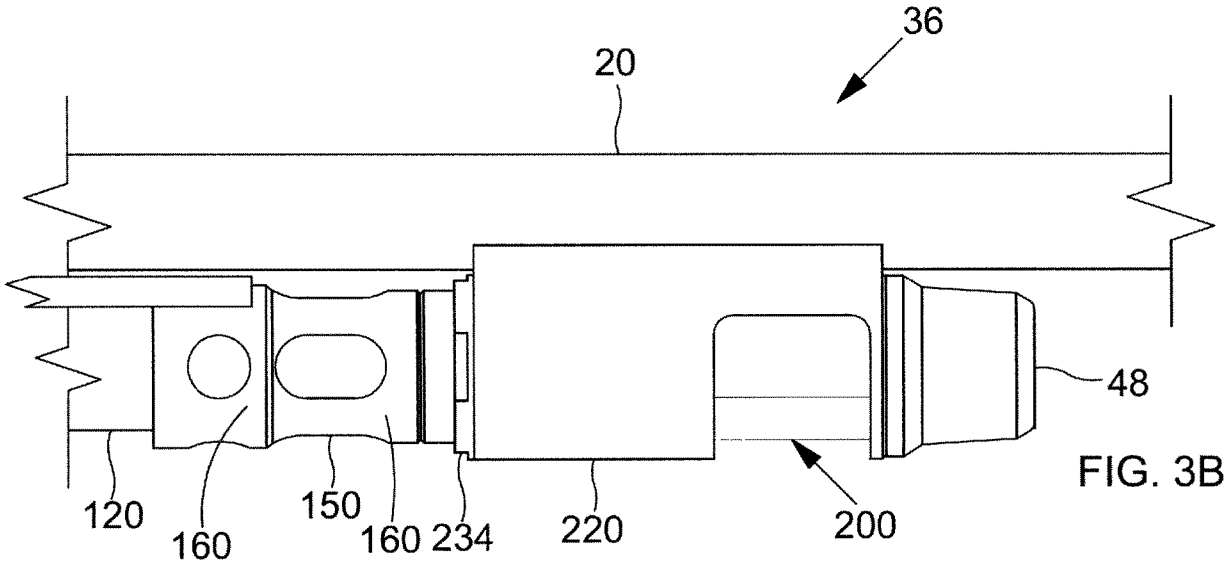
FIG. 3B is an enlarged side view further illustrating a portion of the shotgun shown in FIG. 3A.
Figure 12:
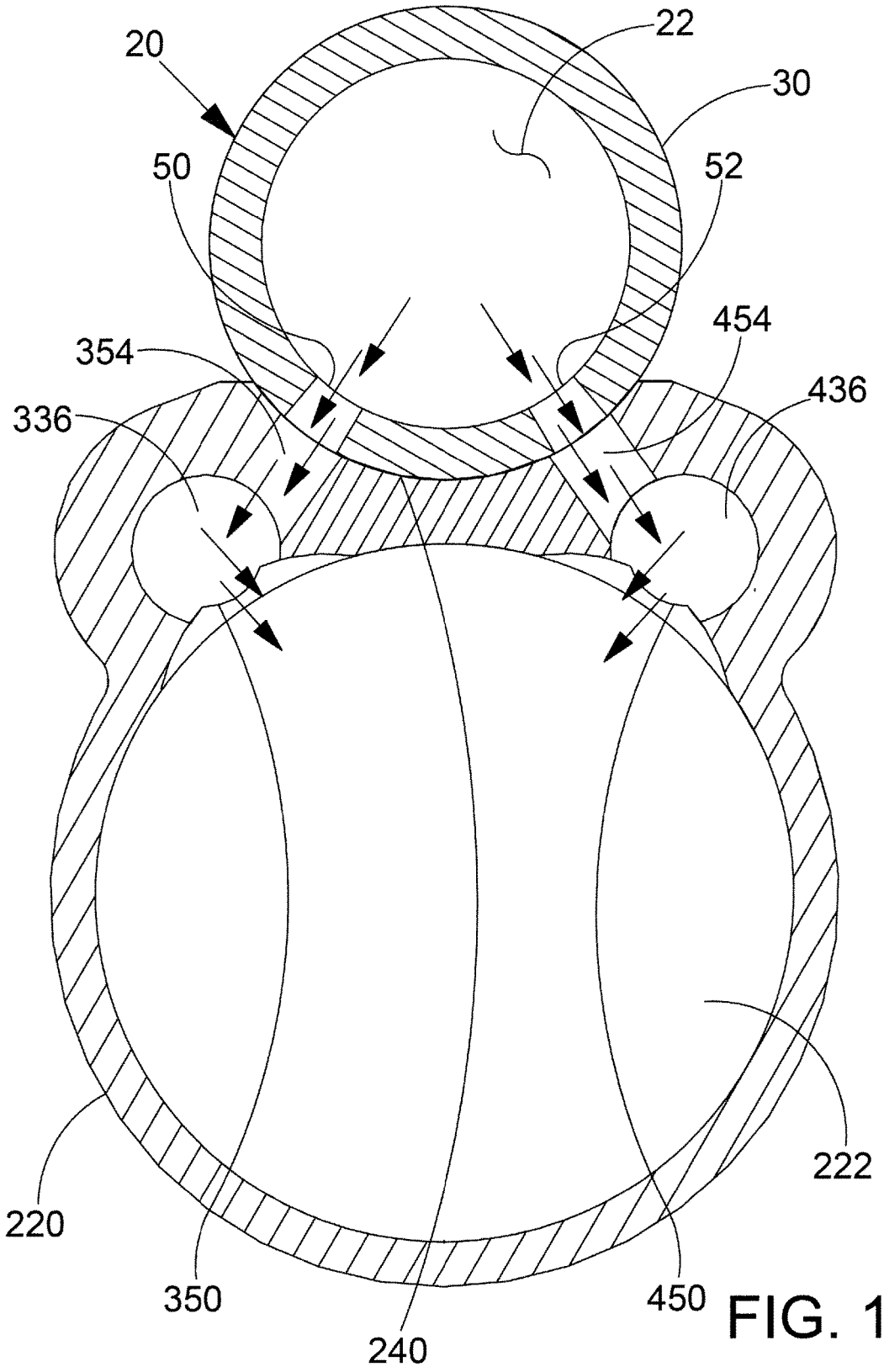
FIG. 12 is a cross-sectional view of a barrel and a gas block in accordance with an embodiment described in the detailed description.
Figure 13A:
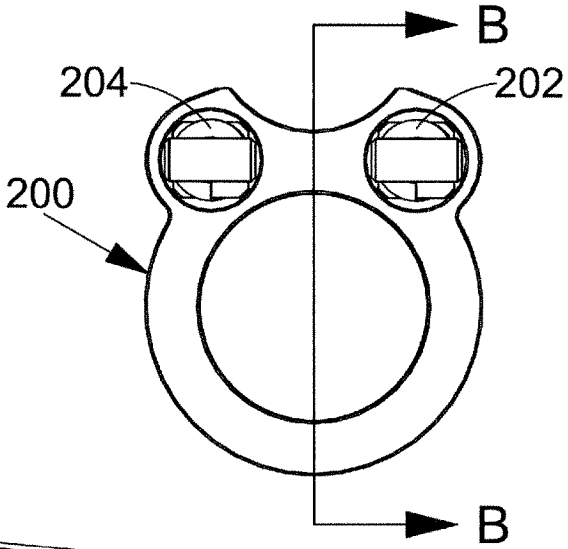
FIG. 13A is a front view showing a gas block assembly and a section line.
Figure 13B:
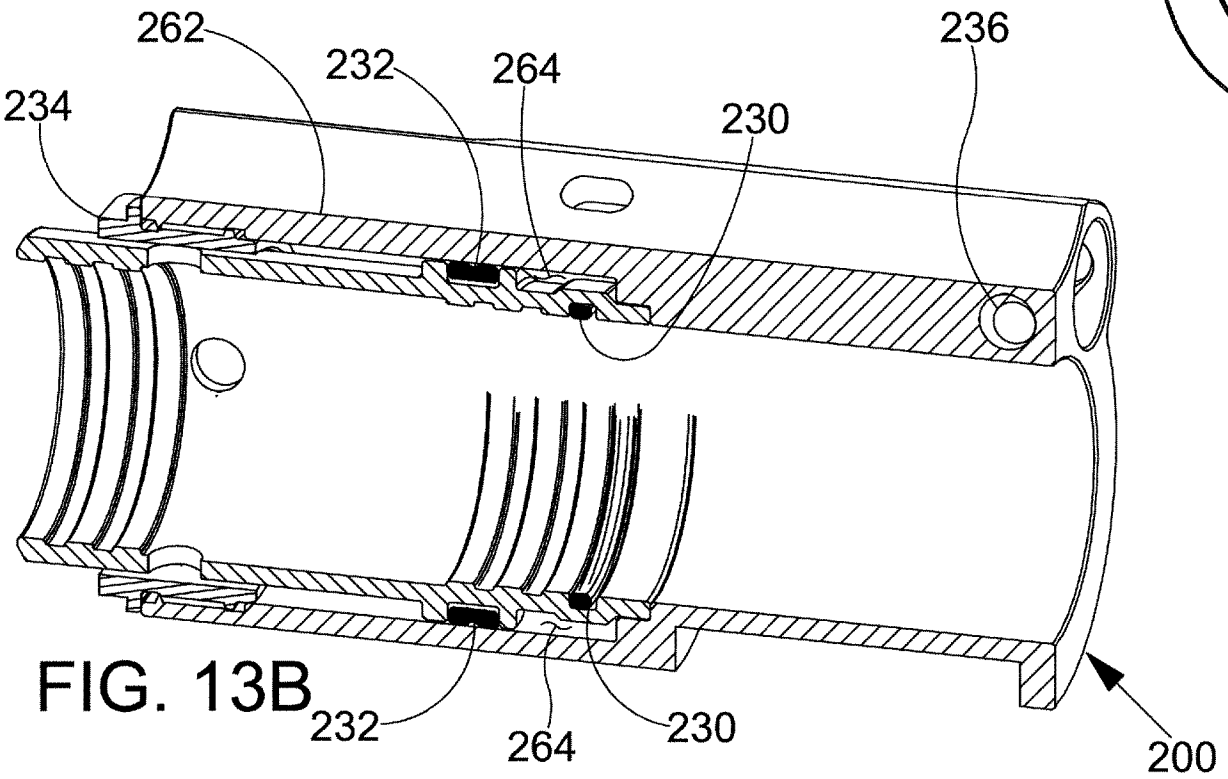
FIG. 13B is a cross-sectioned perspective view of the gas block assembly shown in FIG. 13A with the cross-sectioning being performed along the section line shown in FIG. 13A.
Figure 13C:
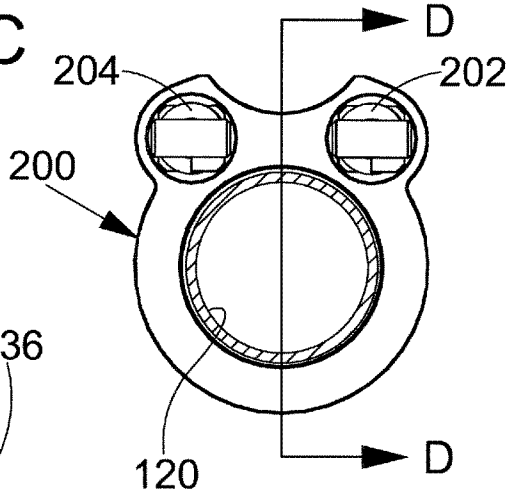
FIG. 13C is a front view showing a gas block assembly and a section line.
Figure 13D:
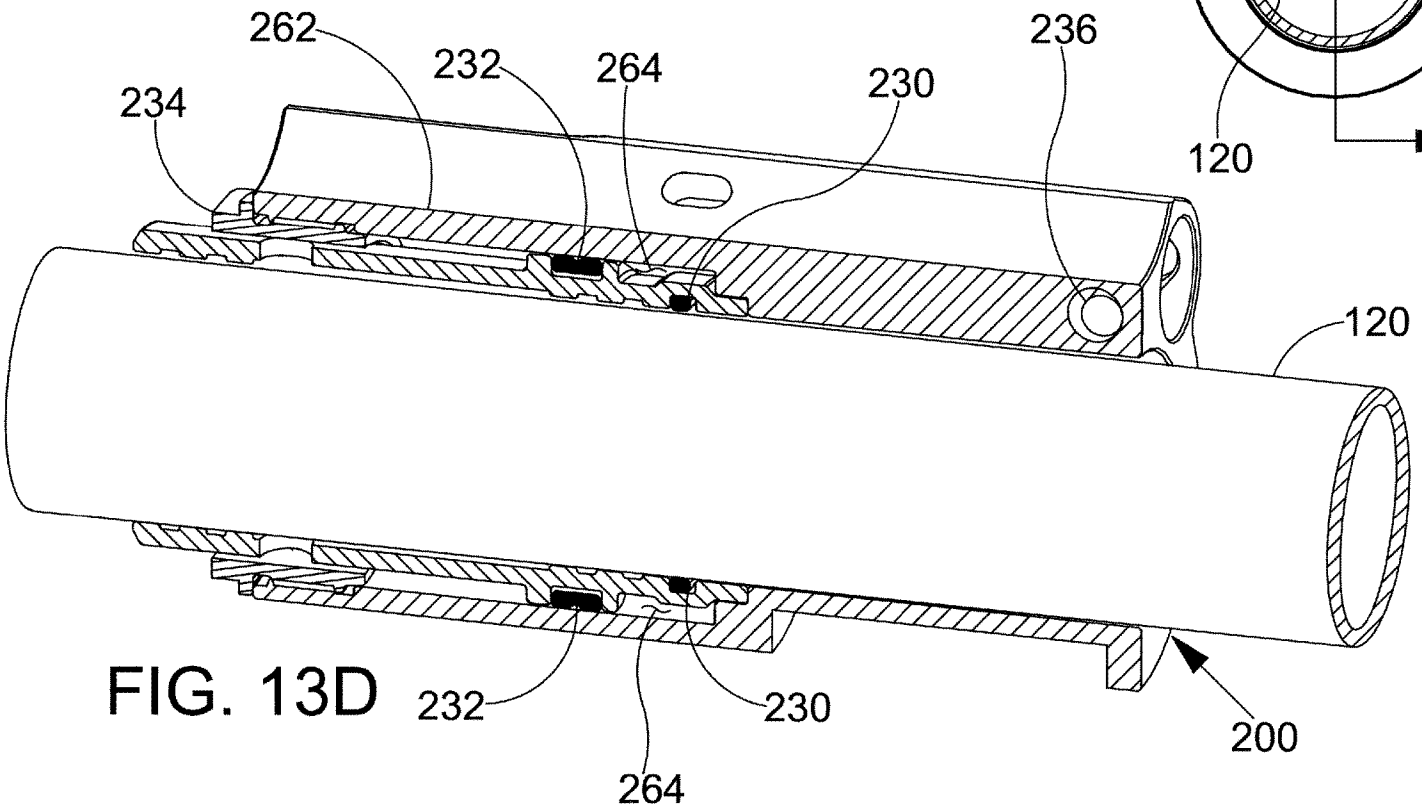
FIG. 13D is a cross-sectioned perspective view of the gas block assembly shown in FIG. 13C with the cross-sectioning being performed along the section line shown in FIG. 13C.
Figure 14:
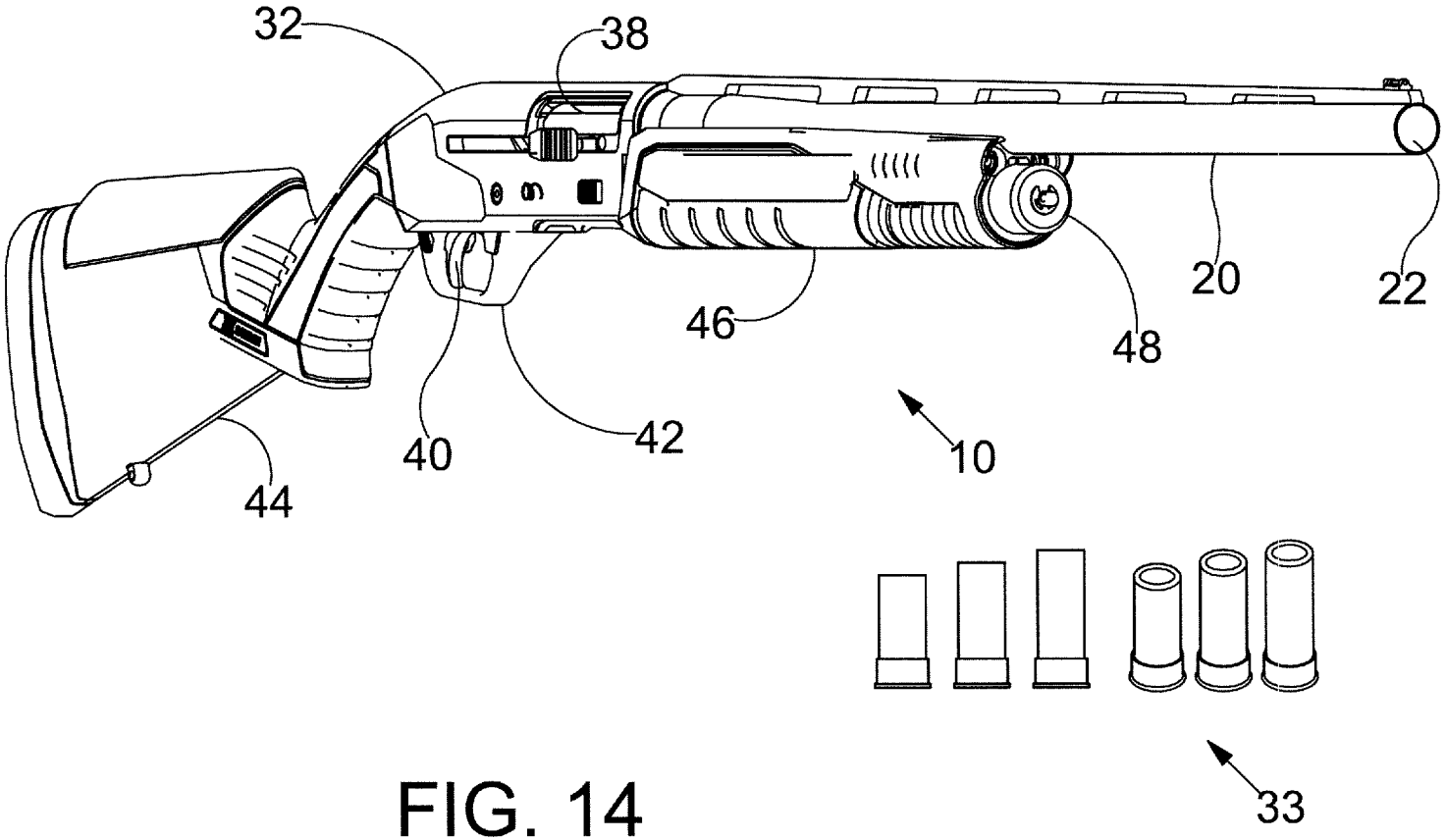
FIG. 14 is a perspective view showing a shotgun in accordance with an embodiment described in the detailed description.
Figure 15A:
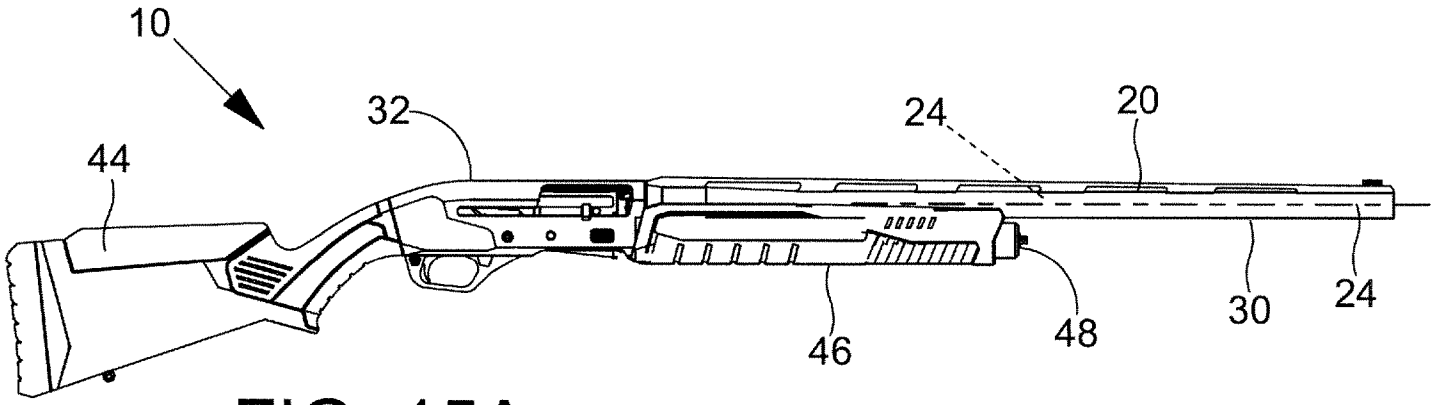
FIG. 15A is a side elevation view showing a shotgun in accordance with an embodiment described in the detailed description.
Figure 15B:
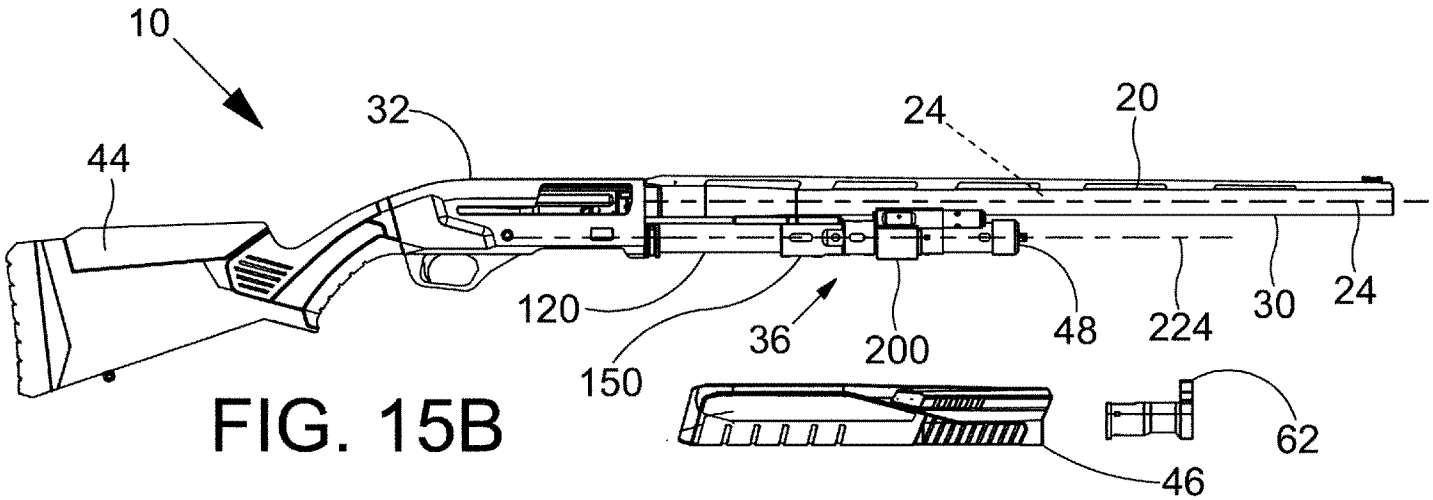
FIG. 15B is a partially exploded side view of the shotgun shown in FIG. 1A.
Figure 16A:
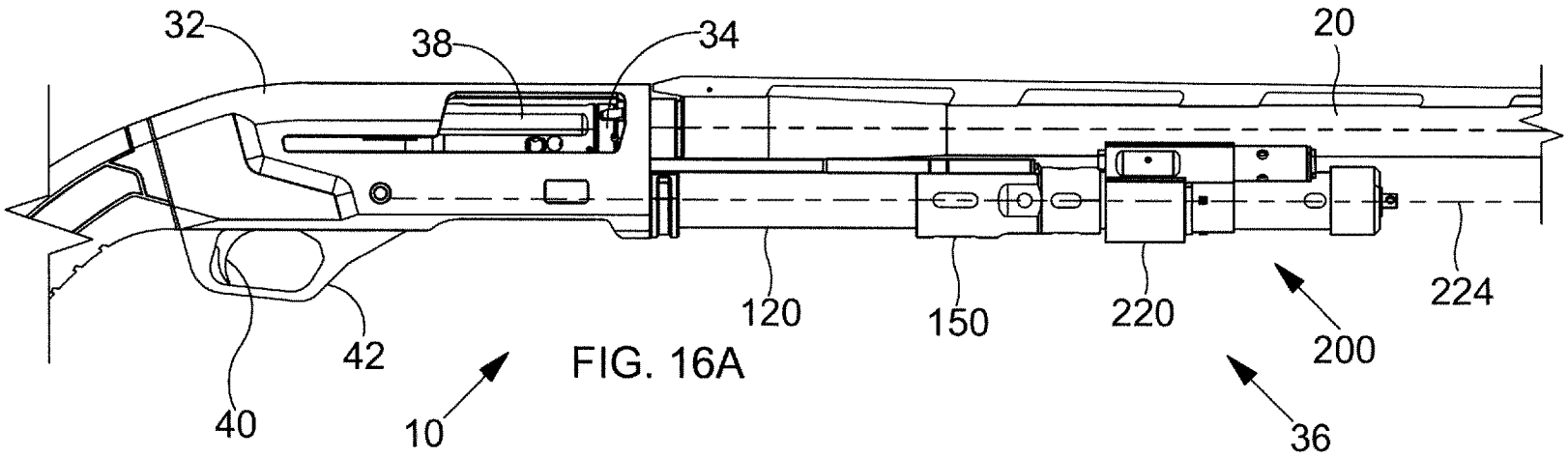
FIG. 16A is an enlarged side view of the shotgun shown in FIG. 15B.
Figure 16B:
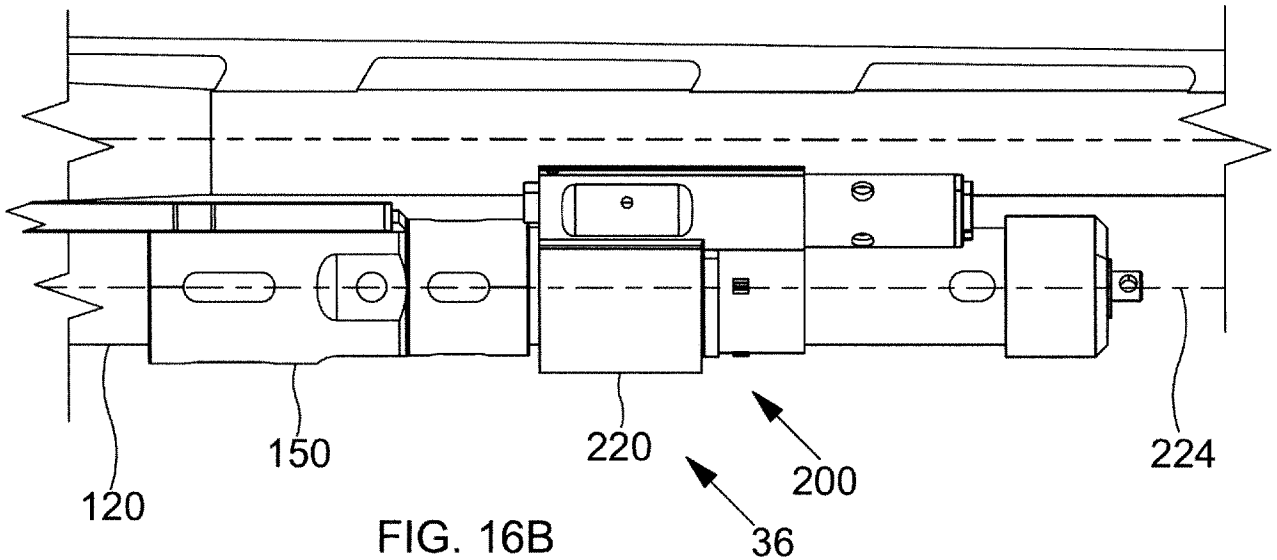
FIG. 16B is an enlarged side view further illustrating a portion of the shotgun shown in FIG. 16A.
Figure 17:
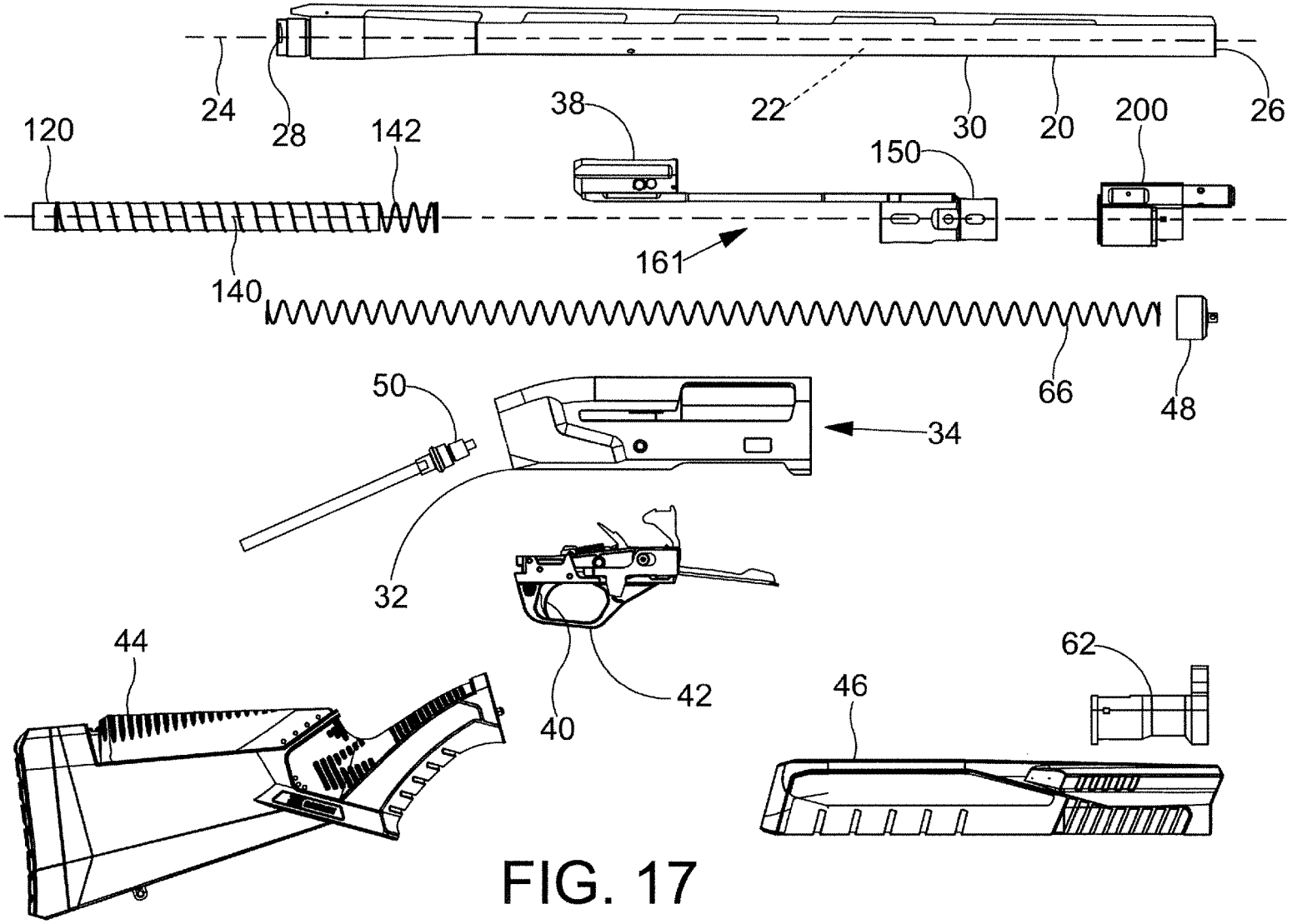
FIG. 17 is an exploded side view of the shotgun shown in FIG. 15A and FIG. 15B.
Figures 18A, 18B:
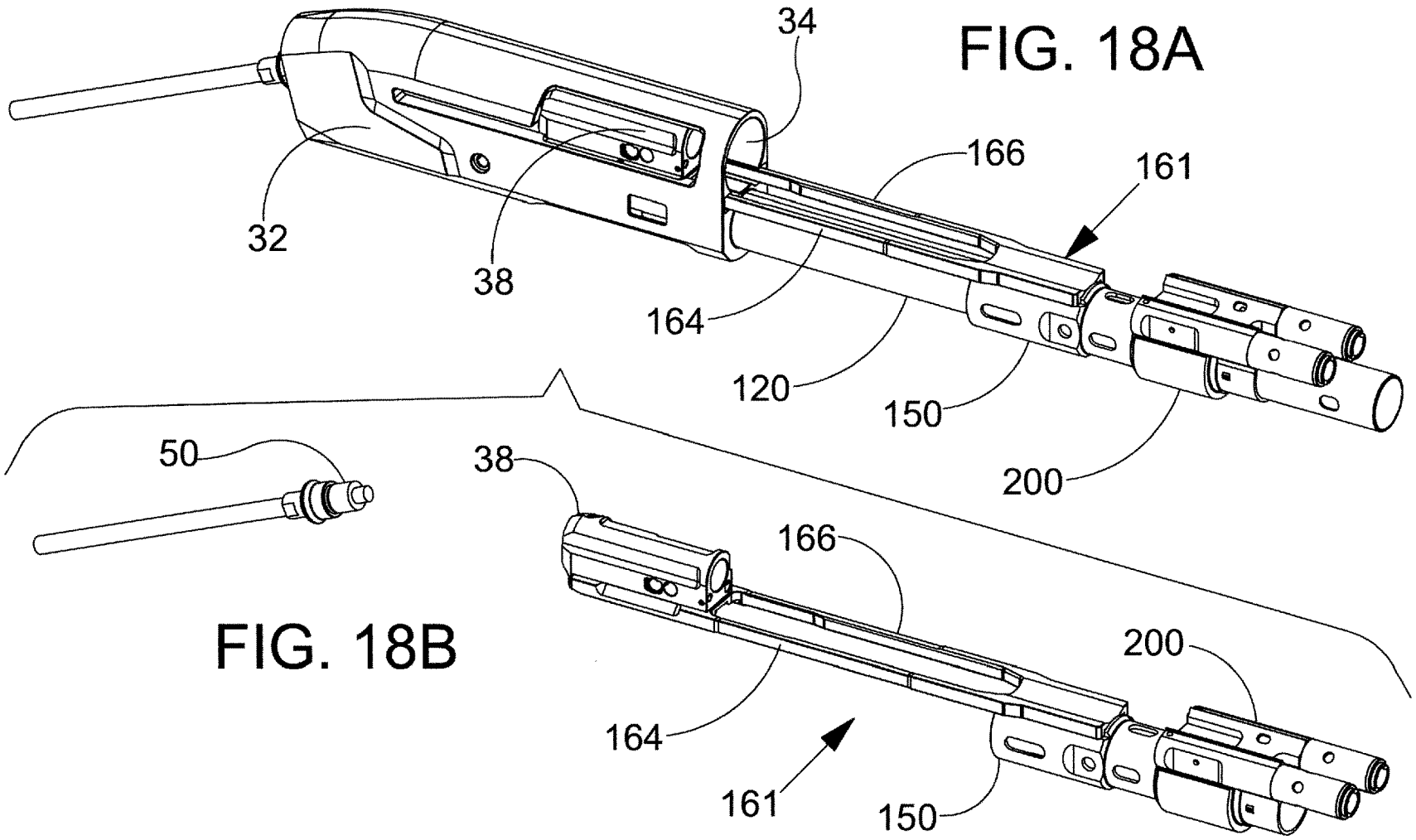
FIG. 18A is a perspective view of an assembly including a receiver and a breech block.
FIG. 18B is a perspective view of the assembly of FIG. 18A with the breech block removed.
Figure 19A:
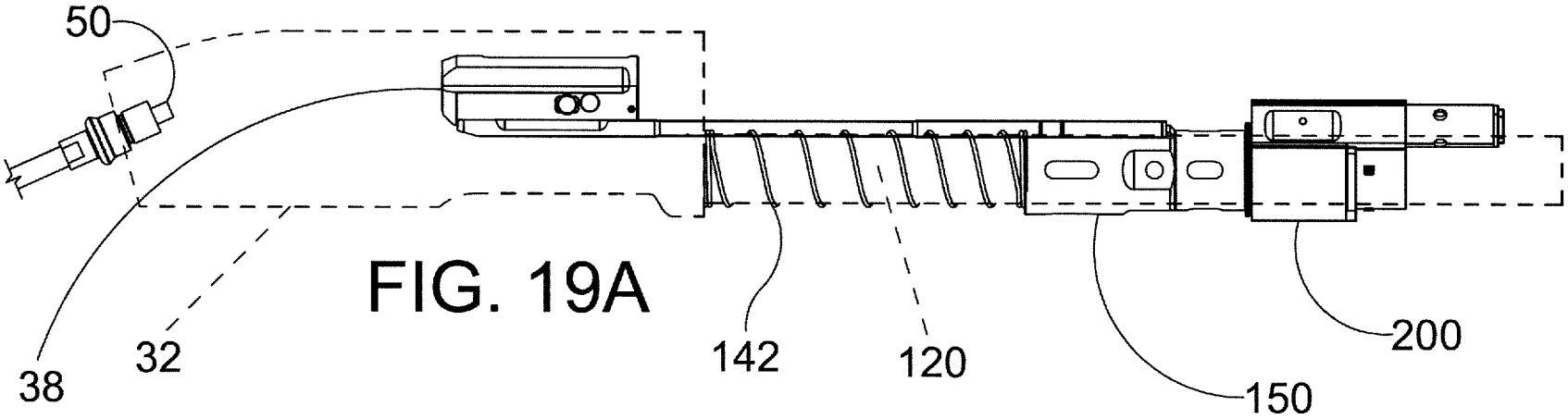
FIG. 19A is a side view of an assembly including a receiver and a breech block. The breech block is disposed in a forward position in the embodiment of FIG. 19A.
Figure 19B:
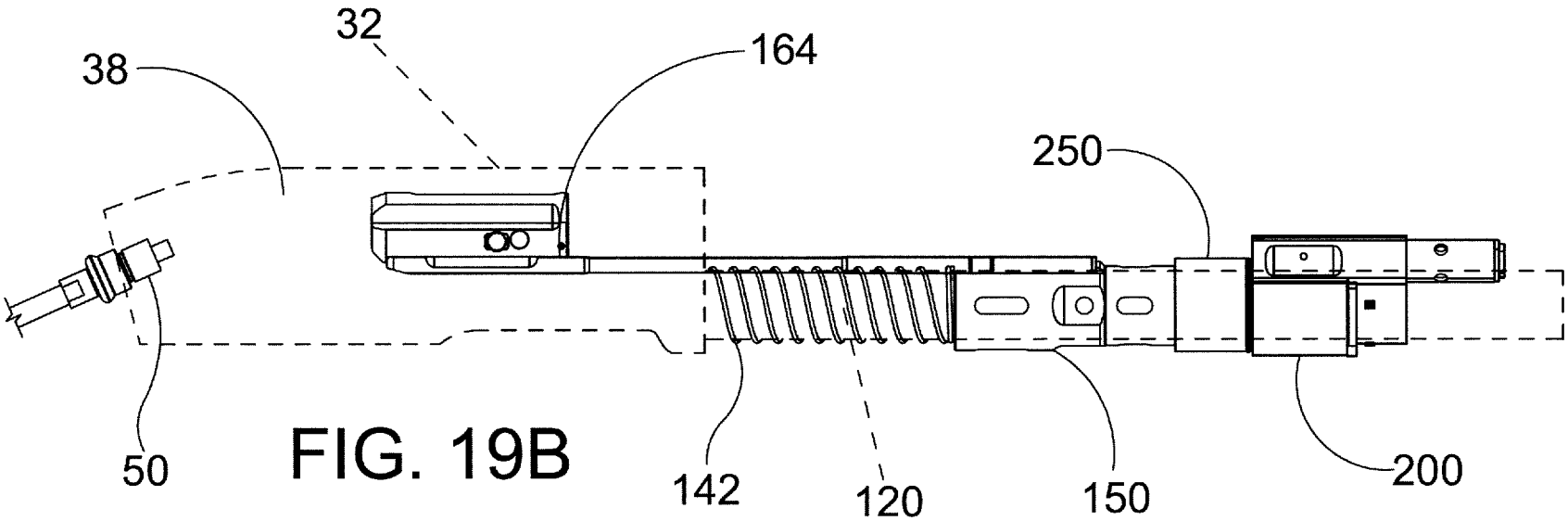
FIG. 19B is a side view of an assembly including a receiver and a breech block. The breech block is shown in an intermediate position in FIG. 19C. The intermediate position is between the forward position and the rearward position.
Figure 19C:
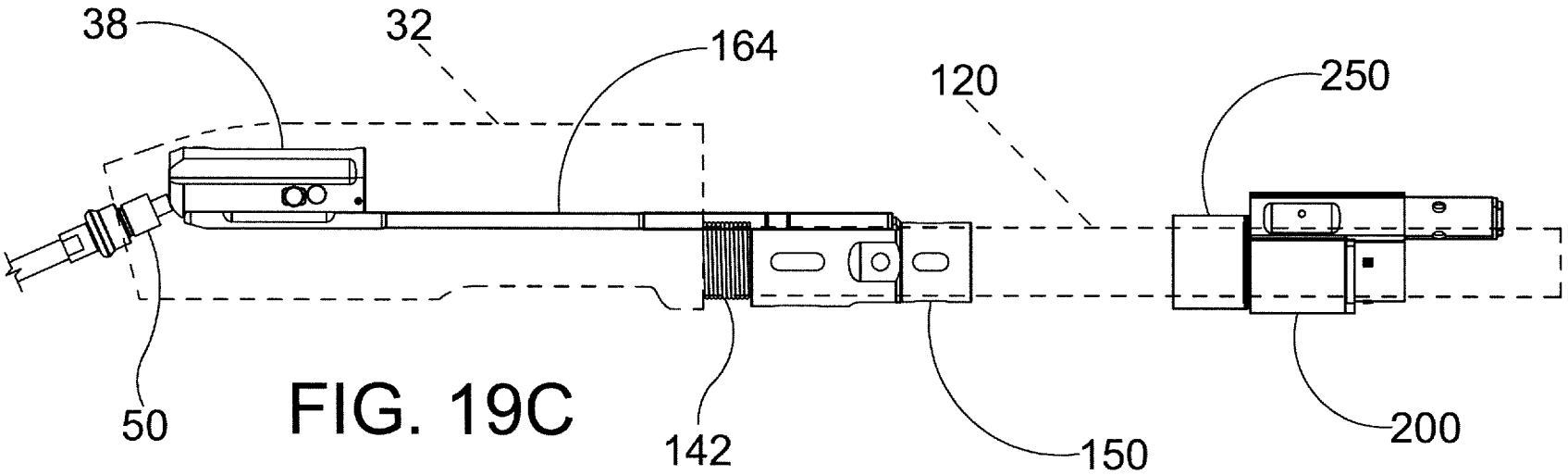
FIG. 19C is a side view of an assembly including a receiver and a breech block. The breech block is disposed in a rearward position in the embodiment of FIG. 19C.
Figure 19D:
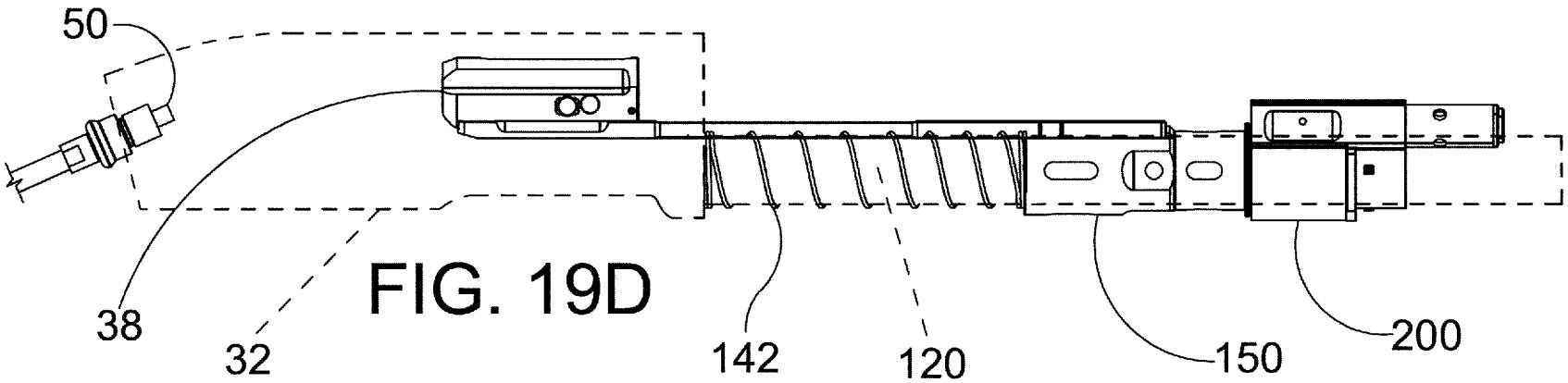
FIG. 19D is a side view of an assembly including a receiver and a breech block. The breech block is disposed in a forward position in the embodiment of FIG. 19D.

Referring, for example, to FIGS. 1, 3A and 12, a semiautomatic shotgun 10 in accordance with one or more embodiments comprises a receiver 32 defining a receiver interior 34 and a breech block 38 that is slidably received in the receiver interior 34. The breech block 38 is movable between a forward position in which the breech block 38 engages the breech end 28 of the barrel 20 for firing a chambered shell and a rearward position in which the breech block 38 is positioned rearward of the breech end 28 of the barrel 20 for discharging a spent shell. A barrel 20 and a magazine tube 120 extend forwardly from a forward portion of the receiver 32. The barrel 20 has a breech end 28 and a muzzle end 26. A barrel wall 30 of the barrel 20 extends from the breech end 28 to the muzzle end 26. The barrel wall 30 defines a barrel bore 22 extending along a barrel axis 24 of the barrel 20. The barrel wall 30 defines a firing chamber and barrel bore 22, the firing chamber being dimensioned and configured to receiving a shell. The magazine tube 120 has a rearward end and a forward end. A magazine wall 130 of the magazine tube 120 extends between the rearward end and the forward end. The magazine wall 130 defines a magazine tube bore extending along a magazine axis of the magazine tube 120. The barrel axis 24 and the magazine axis 140 define a vertical plane.

A semiautomatic shotgun in accordance with the embodiments described in the preceding paragraph may further include a gas block assembly 200 including a gas block 220 that is disposed about the magazine tube 120 with the magazine tube 120 extending through the block bore 222 defined by the gas block 220. The gas block assembly 200 includes a starboard regulator assembly 320 and a port regulator assembly 420. The gas block 220 defines a starboard regulator cavity 322 and a port regulator cavity 422. The starboard regulator cavity 322 extends along a starboard regulator axis 340 and the port regulator cavity 422 extends along a port regulator axis 440. The starboard regulator axis 340 and the port regulator axis 440 define a horizontal plane. In one or more embodiments, the horizontal plane defined by the starboard regulator axis 340 and the port regulator axis 440 is perpendicular to the vertical plane defined by the barrel axis 24 and the magazine axis 140. In one or more embodiments, the starboard regulator assembly 320 and the starboard regulator cavity 322 are disposed starboard of the vertical plane defined by the barrel axis 24 and the magazine axis 140. In one or more embodiments, the starboard regulator assembly 320 and the starboard regulator cavity 322 are disposed below the barrel axis 24 and above the magazine axis 140. In one or more embodiments, the port regulator assembly 420 and the port regulator cavity 422 are disposed portward of the vertical plane defined by the barrel axis 24 and the magazine axis 140. In one or more embodiments, the port regulator assembly 420 and the port regulator cavity 422 are disposed below the barrel axis 24 and above the magazine axis 140.

A semiautomatic shotgun in accordance with the embodiments described in the preceding paragraph may further include a sleeve 252 comprising a sleeve wall 262 extending into the block bore 222 defined by a gas block 220 with a portion of the sleeve 252 disposed between an outer surface of the magazine tube 120 and inner surface of the gas block 220. In one or more embodiments, the magazine tube 120, the sleeve 252, and the gas block 220 cooperate to define an annular volume 264. The annular volume 238 communicates with the barrel bore 22 so that combustion gasses can enter the annular volume 238. The starboard regulator assembly 320 acts to release combustion gasses when the combustion gasses in the barrel bore 22 and/or the annular volume 238 reaches a first predetermined pressure. The port regulator assembly 420 acts to release combustion gasses when the combustion gasses in the barrel bore 22 and/or the annular volume 238 reaches a first predetermined pressure. In one or more embodiments, the first predetermined pressure and the second predetermined pressure are different. In one or more embodiments, the first predetermined pressure is selected to correspond to a first shotshell load and the second predetermined pressure is selected to correspond to a second shotshell load. In one or more embodiments, the first predetermined pressure and the second predetermined pressure are substantially equal. In one or more embodiments, the first predetermined pressure and the second predetermined pressure have values within 10% of one another.

Referring, for example, to FIGS. 16-25B, a semiautomatic shotgun 10 in accordance with one or more embodiments comprises a receiver 32, a barrel 20 and a magazine tube 120. The barrel 20 and the magazine tube 120 both extend forward beyond a forward end of the receiver 32 with the magazine tube 120 being located below the barrel 20. In an embodiment, a gas operated mechanism 36 is disposed about the magazine tube 120. In an embodiment, the gas operated mechanism 36 comprises a gas block assembly 200 that including an annular shaped piston 250. In an embodiment, the annular shaped piston 250 extends into a block bore 222 defined by a gas block 220 of the gas block assembly 200. In an embodiment, the block bore 222 extends along a block bore axis 224. In an embodiment, the gas block assembly 200 includes a starboard regulator housing 338 defining starboard regulator cavity 322 that extends along a starboard regulator axis 340. In an embodiment, the starboard regulator housing 338 comprises a first starboard male thread 362 and the first starboard male thread 362 is disposed in threaded engagement with a first starboard female thread 364 of the gas block 220. In an embodiment, a starboard valve member 330 is disposed in the starboard regulator cavity 322 with a seating surface of the starboard valve member 330 is biased to seat against a complementary surface of the starboard regulator housing 338 by a starboard spring 332. In an embodiment, a forward end of the starboard spring 332 seats against the starboard valve member 330 and a rearward end of the starboard spring 332 seats against a starboard retainer 336. In an embodiment, the starboard retainer 336 comprises a second starboard male thread 366 and the second starboard male thread 366 is disposed in threaded engagement with a second starboard female thread 368 of the starboard regulator housing 338. In an embodiment, the gas block assembly 200 includes a port regulator housing 438 defining port regulator cavity 422 that extends along a port regulator axis 440. In an embodiment, the port regulator housing 438 comprises a first port male thread 462 and the first port male thread 462 is disposed in threaded engagement with a first port female thread 464 of the gas block 220. In an embodiment, a port valve member 430 is disposed in the port regulator cavity 422 with a seating surface of the port valve member 430 is biased to seat against a complementary surface of the port regulator housing 438 by a port spring 432. In an embodiment, a forward end of the port spring 432 seats against the port valve member 430 and a rearward end of the port spring 432 seats against a port retainer 436. In an embodiment, the port retainer 436 comprises a second port male thread 466 and the second port male thread 466 is disposed in threaded engagement with a second port female thread 468 of the port regulator housing 438. In an embodiment, the starboard regulator axis 340, the port regulator axis 440, and the block bore axis 224 define a triangular prism comprising a first base, a second base and three side faces. In an embodiment, the starboard regulator axis 340 and the block bore axis 224 define a first plane P1 and a first side face of the triangular prism lies in the first plane P1. In an embodiment, the port regulator axis 440 and the block bore axis 224 define a second plane P2 and a second side face of the triangular prism lies in the second plane P2. In an embodiment, the starboard regulator axis 340 and the port regulator axis 440 define a third plane P3 and a third side face of the triangular prism lies in the third plane P3.

Referring, for example, to FIGS. 1A-3B and 12, a semiautomatic shotgun 10 in accordance with one or more embodiments comprises a receiver 32 defining a receiver interior 34 and a barrel 20 attached to a forward portion of the receiver 32. The barrel 20 has a breech end 28 and a muzzle end 26. A barrel wall 30 of the barrel 20 extends from the breech end 28 to the muzzle end 26. The barrel wall 30 defines a barrel bore 22 extending along a longitudinal axis of the barrel 20. The barrel wall 30 defines a firing chamber and barrel bore 22, the firing chamber being dimensioned and configured to receiving a shell.

A breech block 38 is slidably received in the receiver interior 34. The breech block 38 is movable between a forward position in which the breech block 38 engages the breech end 28 of the barrel 20 for firing a chambered shell and a rearward position in which the breech block 38 is positioned rearward of the breech end 28 of the barrel 20 for discharging a spent shell. A magazine tube 120 is attached to a forward portion of the receiver 32. The magazine tube 120 has a rearward end and a forward end. A magazine wall 130 of the magazine tube 120 extends between the rearward end and the forward end. The magazine wall 130 defines a magazine tube bore extending along a longitudinal axis of the magazine tube 120.

The semiautomatic shotgun 10 includes a sleeve 252 comprising a sleeve wall 262. The sleeve wall 262 extending between an outer surface and an inner surface. The inner surface of the sleeve wall 262 defines a lumen 254. The sleeve 252 is positioned so that the sleeve wall 262 encircles the magazine tube 120 with the magazine tube 120 extending through the lumen 254. The sleeve 252 has a rearward end and a forward end. The sleeve wall 262 extends between the forward end and the rearward end. A first sleeve ring 230 is disposed between an inner surface of the sleeve 252 and an outer surface of the magazine tube 120. The first sleeve ring 230 defines a slit 244.

The semiautomatic shotgun 10 includes a gas block assembly 200 with regulators or pressure relief valves 202, 204. The gas block 220 defining a block bore 222. The magazine tube 120 extends through the block bore 222 defined by the gas block 220. The block bore 222 may extend along a block bore axis 224. The sleeve 252 extends into the block bore 222 defined by a gas block 220 with a portion of the sleeve 252 being disposed between an outer surface of the magazine tube 120 and inner surface of the gas block 220. A second sleeve ring 232 is disposed between an outer surface of the sleeve 252 and an inner surface of the gas block 220. The second sleeve ring 232 defining a slot 242. The magazine tube 120, the sleeve 252, and the gas block 220 cooperate to define an annular volume 264. A stop ring 234 is received in the lumen defined by the sleeve wall 262.

The gas block 220 defines a channel 240 and an upward facing opening fluidly communicating with the channel 240. The barrel 20 extends into the channel 240. In one or more embodiments, the gas block 220 is fixed to the barrel 20. The gas block 220 has a rearward end and a forward end. The gas block 220 has a body 246 extending in a forward direction from the rearward end to the forward end and extending in a rearward direction from the forward end to the rearward end. The body 246 of the gas block 220 defines a starboard regulator cavity 322 and a port regulator cavity 422.

The starboard regulator cavity 322 comprises a forward starboard bore 335, a rearward starboard bore 338 and a starboard valve seat 346 disposed between the forward starboard bore 335 and the rearward starboard bore 338. The forward starboard bore 335 extends in the forward direction away from the starboard valve seat 346. The rearward starboard bore 338 extends in the rearward direction away from the starboard valve seat 346. The forward starboard bore 335 is defined by a forward starboard bore surface 340 of the gas block 220. The rearward starboard bore 338 is defined by a rearward starboard bore surface 342. The starboard valve seat 346 comprises a starboard valve seat surface 348 extending between the forward starboard bore surface 340 and the rearward starboard bore surface 342. The forward starboard bore 335 has a first diameter, the rearward starboard bore 338 has a second diameter. In one or more embodiments, the second diameter is greater than the first diameter. The forward starboard bore surface 340 meets the starboard valve seat surface 348 at a starboard edge 344. A starboard valve member 330 is disposed in the starboard regulator cavity 322. A seating surface of the starboard valve member 330 is biased to seat against the starboard edge 344 by a starboard spring 332. A starboard guide 334 extends through a lumen defined by the starboard spring 332 and into a starboard valve member pocket 352 defined by the starboard valve member 330.

The forward starboard bore 335 of the starboard regulator cavity 322 fluidly communicates with the barrel bore 22 via a starboard first passageway 354 defined by the gas block 220 and a starboard hole 50 defined by the barrel 20. The forward starboard bore 335 of the starboard regulator cavity 322 fluidly communicates with the annular volume 264 via a starboard aperture 350. Upon firing a shell with the shotgun, combustion gasses within the barrel 20 enter the annular volume via the starboard hole 50 and the port hole 52 to move the sleeve 252 and a slider 150 rearward for cycling a mechanism 36 disposed in the receiver interior 34.

The slider 150 comprising a slider wall 160. The slider wall 160 has an outer surface and an inner surface with the inner surface defining a lumen. The slider 150 is positioned so that the slider wall 160 encircles the magazine tube 120 and the magazine tube 120 extends through the lumen. The slider 150 having a rearward end and a forward end. The slider wall 160 extends between the rearward end and the forward end. A slider assembly 161 includes the slider 150 and a starboard leg 162 having a forward end and a rearward end. A portion of the starboard leg 162 proximate the forward end is fixed to the slider 150. A portion of the starboard leg 162 proximate the rearward end engages the mechanism 36 disposed inside the receiver interior 34. The slider assembly 161 also includes a port leg 164 having a forward end and a rearward end. A portion of the port leg 164 proximate the forward end is fixed to the slider 150. A portion of the port leg 164 proximate the rearward end engages the mechanism 36 disposed inside the receiver interior 34. The semiautomatic shotgun 10 also includes a trigger 40, a trigger guard 42, a buttstock 44, a fore stock 46 and a cap 48.

The port regulator cavity 422 comprises a forward port bore 435, a rearward port bore 438 and a port valve seat 446 disposed between the forward port bore 435 and the rearward port bore 438. The forward port bore 435 extends in the forward direction away from the port valve seat 446. The rearward port bore 438 extends in the rearward direction away from the port valve seat 446. The forward port bore 435 is defined by a forward port bore surface 440 of the gas block 220. The rearward port bore 438 is defined by a rearward port bore surface 442. The port valve seat 446 comprises a port valve seat surface 448 extending between the forward port bore surface 440 and the rearward port bore surface 442. The forward port bore 435 has a first diameter, the rearward port bore 438 has a second diameter. In one or more embodiments, the second diameter is greater than the first diameter. The forward port bore surface 440 meets the port valve seat surface 448 at a port edge 444. A port valve member 430 is disposed in the port regulator cavity 422. A seating surface of the port valve member 430 is biased to seat against the port edge 444 by a port spring 432. A port guide 434 extends through a lumen defined by the port spring 432 and into a port valve member pocket 452 defined by the port valve member 430.

The forward port bore 435 of the port regulator cavity 422 fluidly communicates with the barrel bore 22 via a port passageway 454 defined by the gas block 220 and a port hole 52 defined by the barrel 20. The forward port bore 435 of the port regulator cavity 422 fluidly communicates with the annular volume 264 via a port aperture 450. Upon firing a shell with the shotgun, combustion gasses within the barrel 20 enter the annular volume via the port hole 52 and the port hole 52 to move the sleeve 252 and a slider 150 rearward for cycling a mechanism 36 disposed in the receiver interior 34.

In embodiments, the semiautomatic shotgun operates as follows. Cartridges of different power levels may be fired without adjusting of modifying the shotgun. Shotshells are loaded conventionally in the magazine. A shell is chambered by retracting the breech block. Upon firing the shell in the chamber explosive gases pass through the two ports in the barrel into the gas block assembly. A pair of passageway extends to the pair of valve chambers and then to the piston chamber. The passage ways to the piston chamber are selected to be a suitable size to restrict the passage of the gas that is to cause a pressure drop. If the pressure in the valve chambers is above a certain predetermined level, the relief valves open to lower the pressure lever. The valves open by the valve members lifting off of their respective valve seats. The pressure level transferred to the piston is then suitable for reliable and long-lasting operation of the recycling mechanism.

In embodiments the piston and piston chamber may be differently configured and still have the advantageous dual regulator arrangement. For example the piston could be cylindrical and engage a tubular cylinder forward of the ammunition chamber or above the ammunition chamber.

In one or more embodiments, the semiautomatic firearm 10 includes a spring 66 that is disposed inside a space defined by the magazine tube. In one or more embodiments, the semiautomatic firearm 10 includes a flange part 62.

Figure 20A:
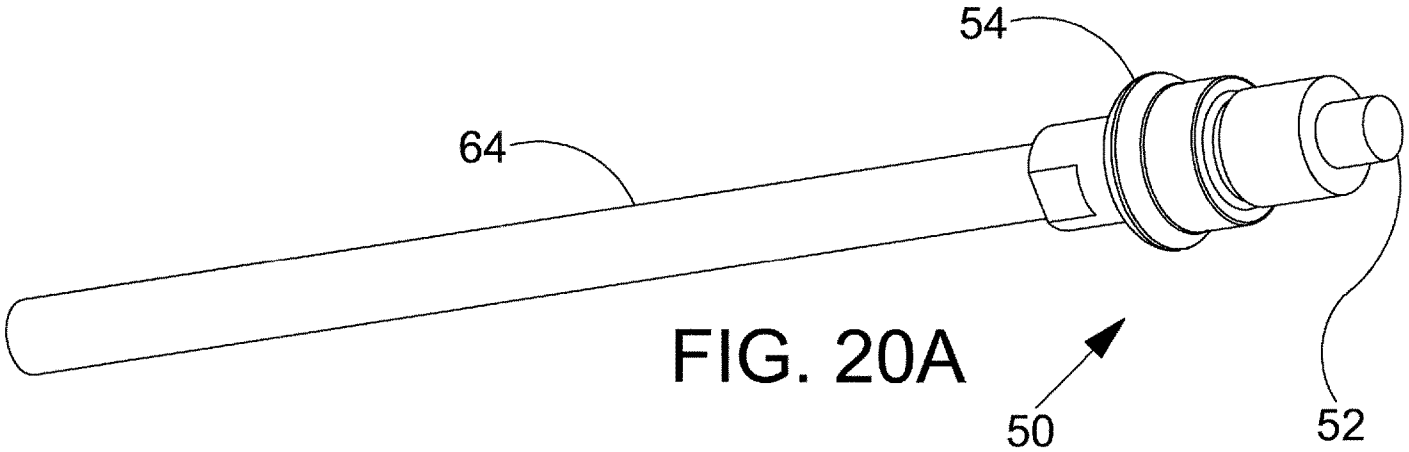
FIG. 20A is a perspective view showing an assembly including a stock rod and a spring loaded plunger assembly.

FIG. 20A is a perspective view showing an assembly including a stock rod 64 and a spring loaded plunger assembly 50. The spring loaded plunger assembly 50 includes a plunger 52 and a plunger housing 54. In one or more embodiments, the plunger housing 54 has a male thread and a female thread. The male thread of the plunger housing 54 may threadingly engage a threaded hole in the receiver of a firearm. The female thread of the plunger housing 54 may threadingly engage one end of the stock rod 64. The stock rod 64 may extend into the buttstock of a firearm.

Figure 20B:
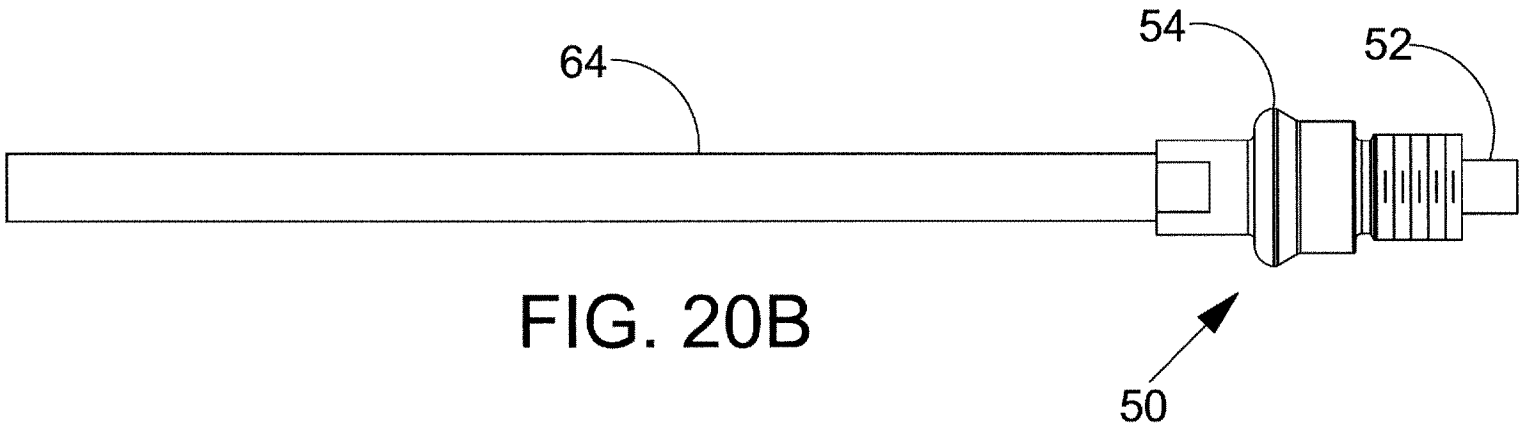
FIG. 20B is a side view showing an assembly comprising a spring loaded plunger assembly including a plunger and a plunger housing.

FIG. 20B is a side view showing an assembly comprising a spring loaded plunger assembly 50 including a plunger 52 and a plunger housing 54. A male thread of the plunger housing is visible in FIG. 20B. The male thread of the plunger housing 54 may threadingly engage a threaded hole in the receiver of a firearm. The assembly of FIG. 20B also includes a stock rod 64 may extend into the buttstock of a firearm. The female thread of the plunger housing 54 may threadingly engage one end of the stock rod 64.

Figure 20C:
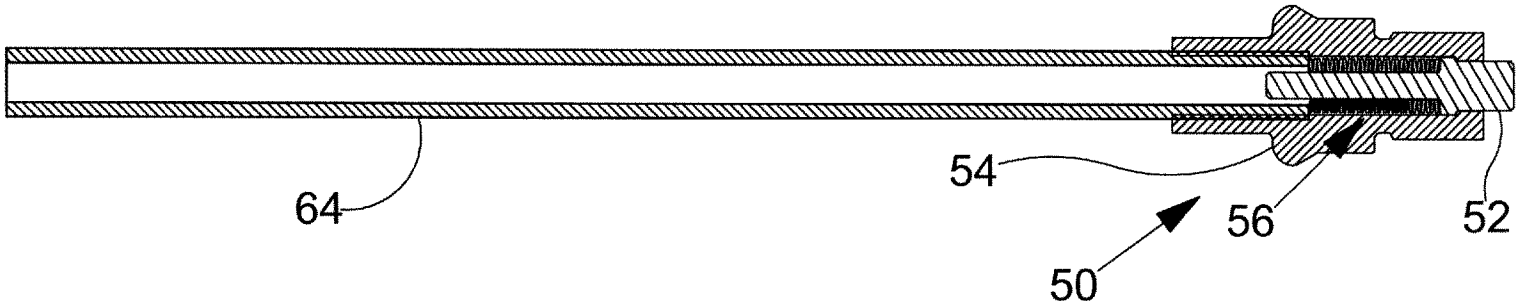
FIG. 20C is a cross-sectional view further illustrating the stock rod and the spring loaded plunger assembly shown in FIG. 20A and FIG. 20B.

FIG. 20C is a cross-sectional view further illustrating the stock rod 64 and the spring loaded plunger assembly 50 shown in FIG. 20A and FIG. 20B. The spring loaded plunger assembly 50 includes a plunger 52, a plunger housing 54, and an elastic element 56. In the embodiment of FIG. 20C, the elastic element 56 comprises a plurality of Belleville washers 60 arranged to form a stack 58.

Figure 20D:
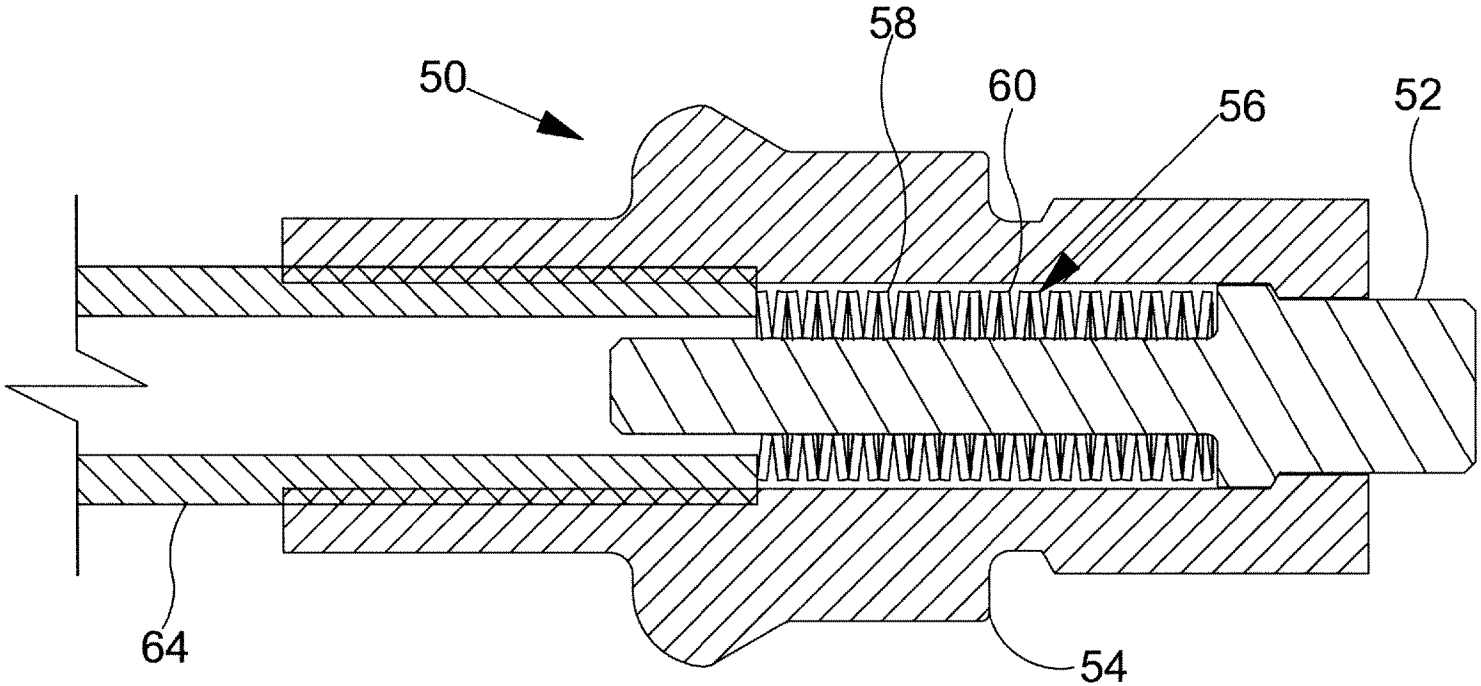
FIG. 20D is an enlarged cross-sectional view further illustrating the spring loaded plunger assembly shown in FIG. 20C.

FIG. 20D is an enlarged cross-sectional view further illustrating the spring loaded plunger assembly 50 shown in FIG. 20C. With reference to FIG. 20D, it will be appreciated that the Belleville washers 60 in the stack 58 are disposed in a series arrangement. In the example embodiment of FIG. 20D, the orientation of adjacent Belleville washers 60 alternates. A portion of plunger 52 can be seen extending into a lumen defined by the stock rod 64 in FIG. 20D.

Figure 20E:
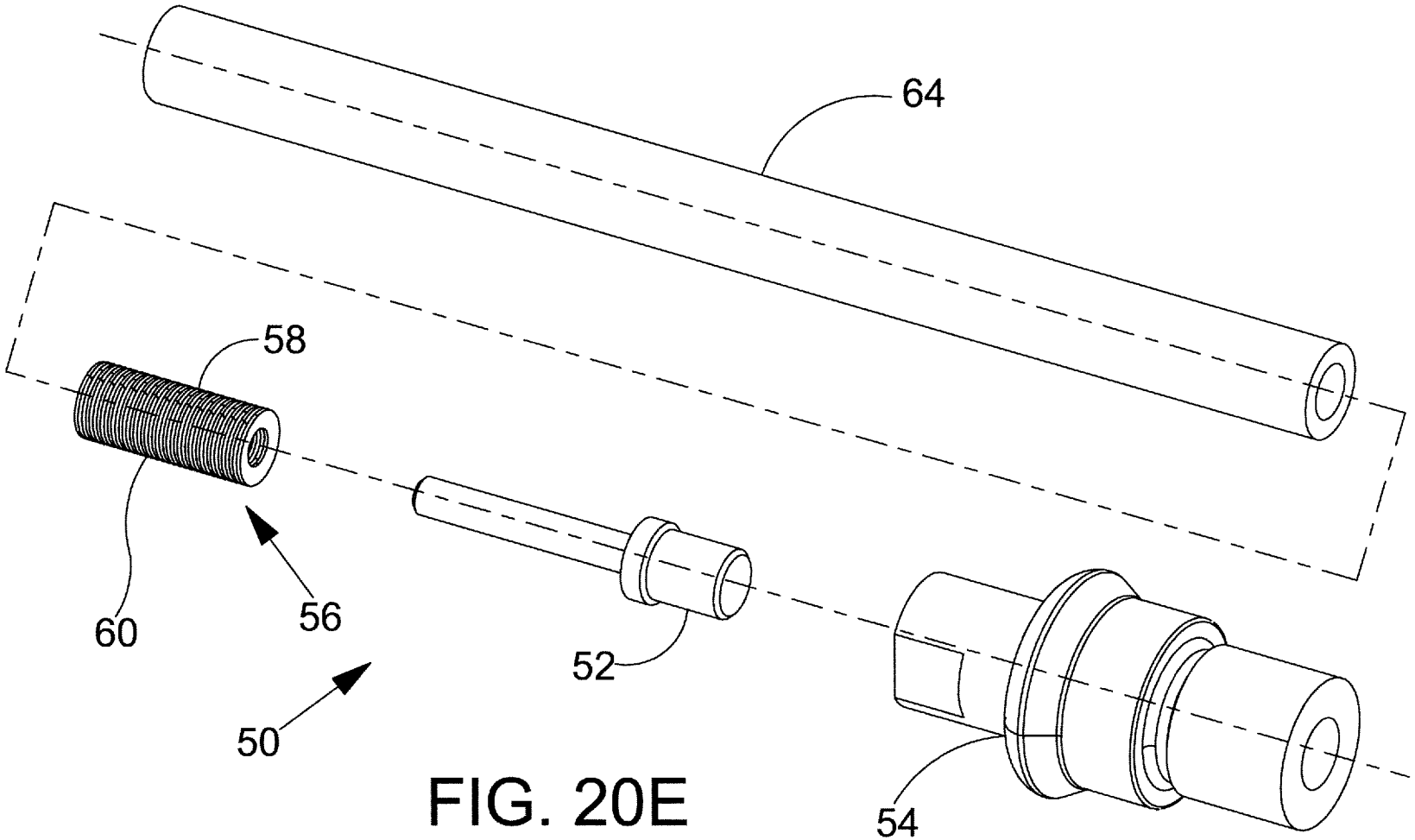
FIG. 20E is an exploded view further illustrating the stock rod and the spring loaded plunger assembly shown in FIG. 20A through FIG. 20D.

FIG. 20E is an exploded view further illustrating the stock rod 64 and the spring loaded plunger assembly 50 shown in FIG. 20A through FIG. 20D. The spring loaded plunger assembly 50 includes a plunger 52 and an elastic element 56 that may be received in a plunger housing 54. In the embodiment of FIG. 20E, the elastic element 56 comprises a plurality of Belleville washers 60 arranged to form a stack 58. A portion of plunger 52 may be inserted into a lumen defined by the stock rod 64 in the embodiment of FIG. 20E. One end of the stock rod 64 may threadingly engage a female thread of the plunger housing 54.

Figure 20F:
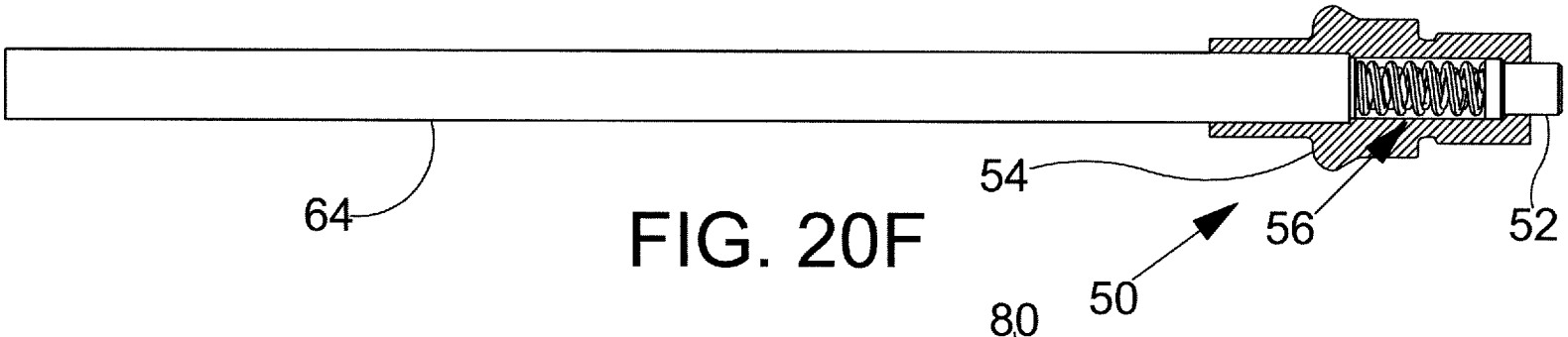
FIG. 20F is a cross-sectional view further illustrating the stock rod and the spring loaded plunger assembly in accordance with an additional embodiment.

FIG. 20F is a cross-sectional view further illustrating the stock rod 64 and the spring loaded plunger assembly 50 in accordance with an additional embodiment. The spring loaded plunger assembly 50 includes a plunger 52, a plunger housing 54, and an elastic element 56. In the embodiment of FIG. 20F, the elastic element 56 comprises a first coil spring 82 and a second coil spring 84.

Figure 20G:
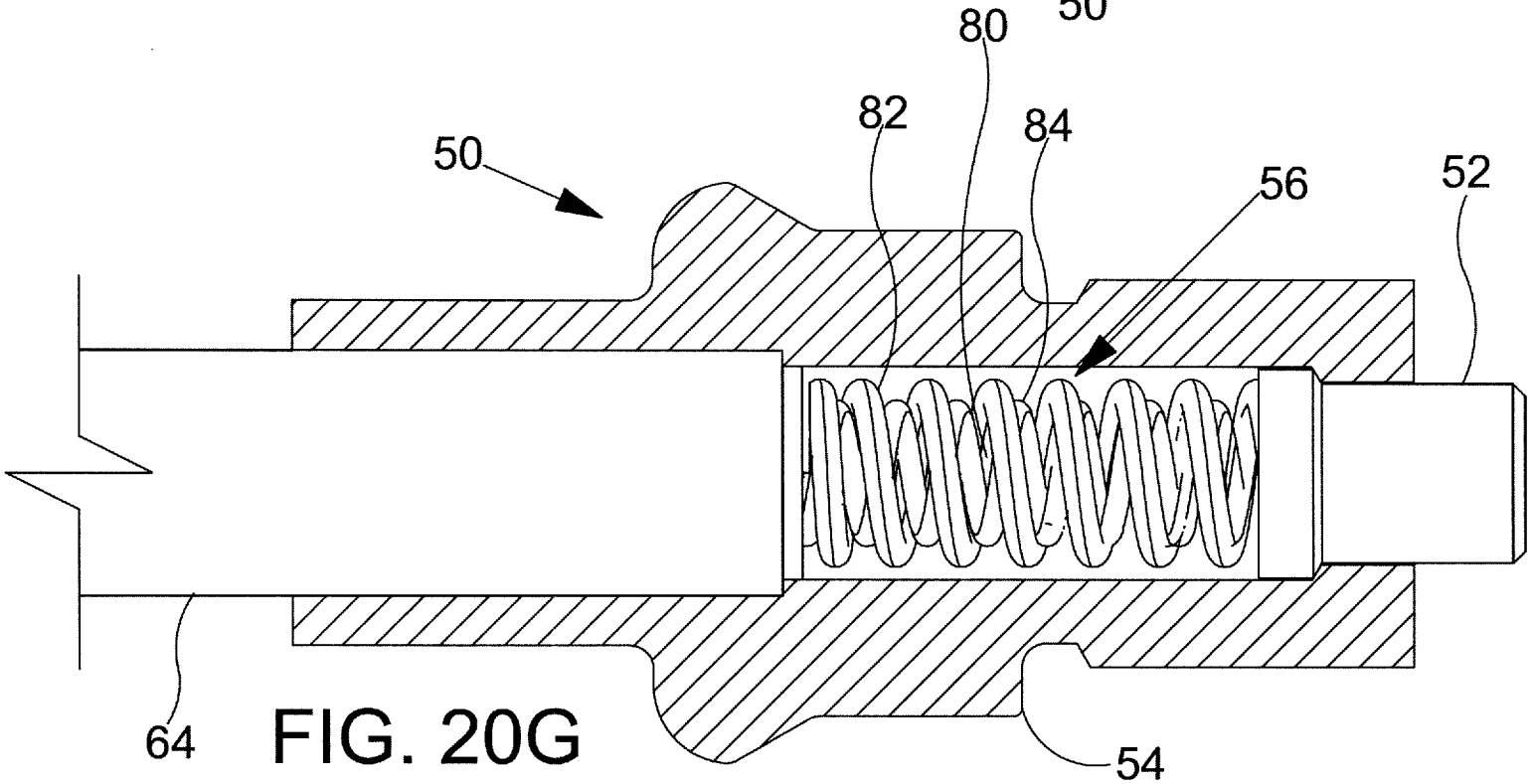
FIG. 20G is an enlarged cross-sectional view further illustrating the spring loaded plunger assembly shown in FIG. 20F.
Figure 21:
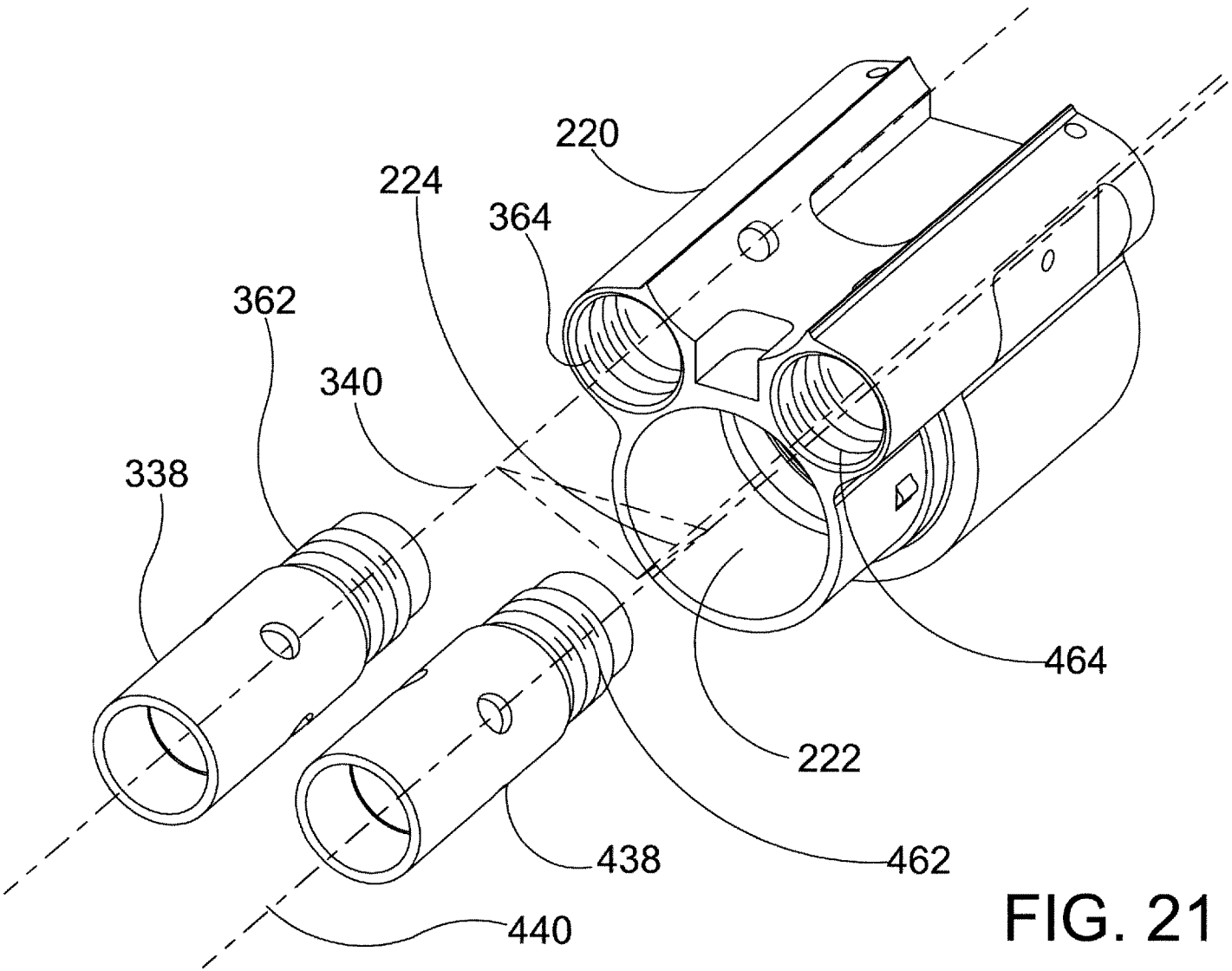
FIG. 21 is an exploded perspective view showing an assembly.
Figure 22:
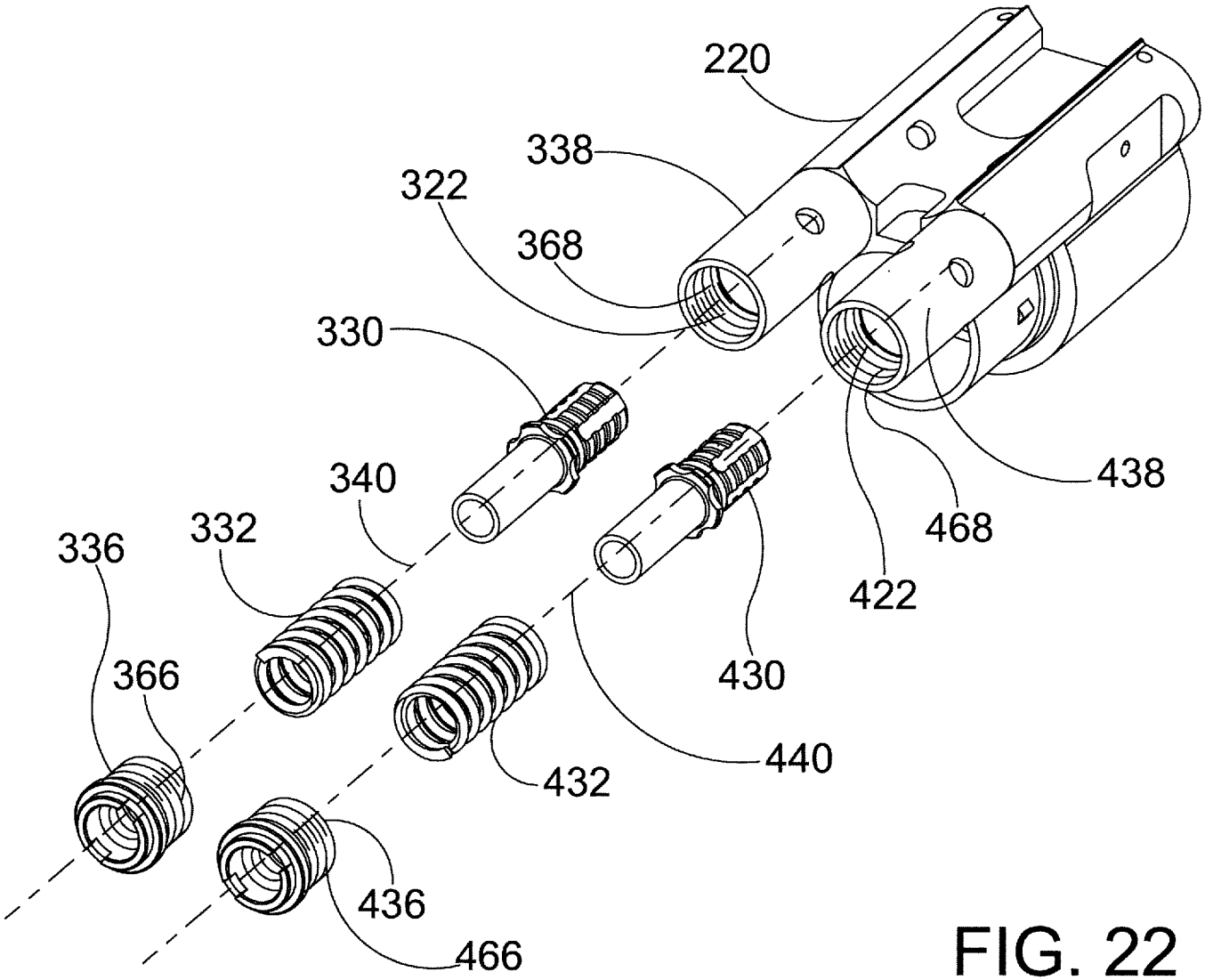
FIG. 22 is an exploded perspective view showing an assembly including the assembly of FIG. 21.
Figure 23:
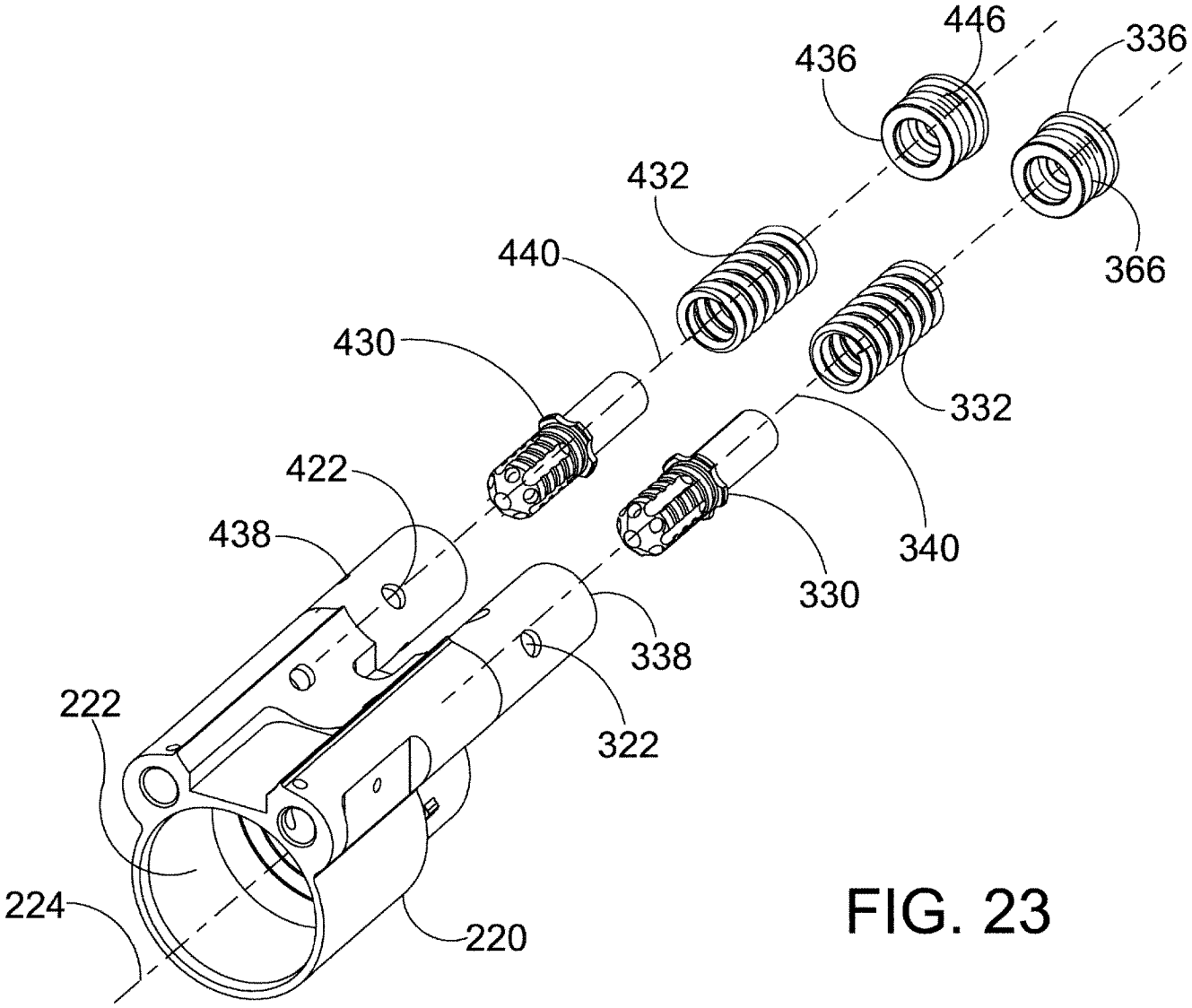
FIG. 23 is an exploded perspective view showing the assembly of FIG. 22 from another viewing angle.
Figure 24A:
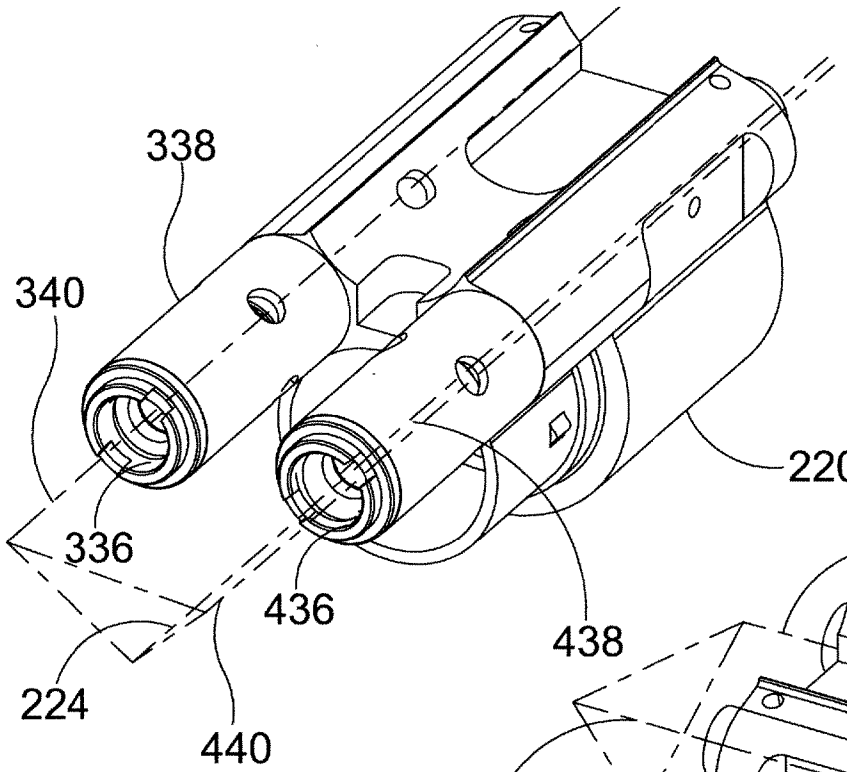
FIG. 24A is an isometric view showing an assembly.
Figure 24B:
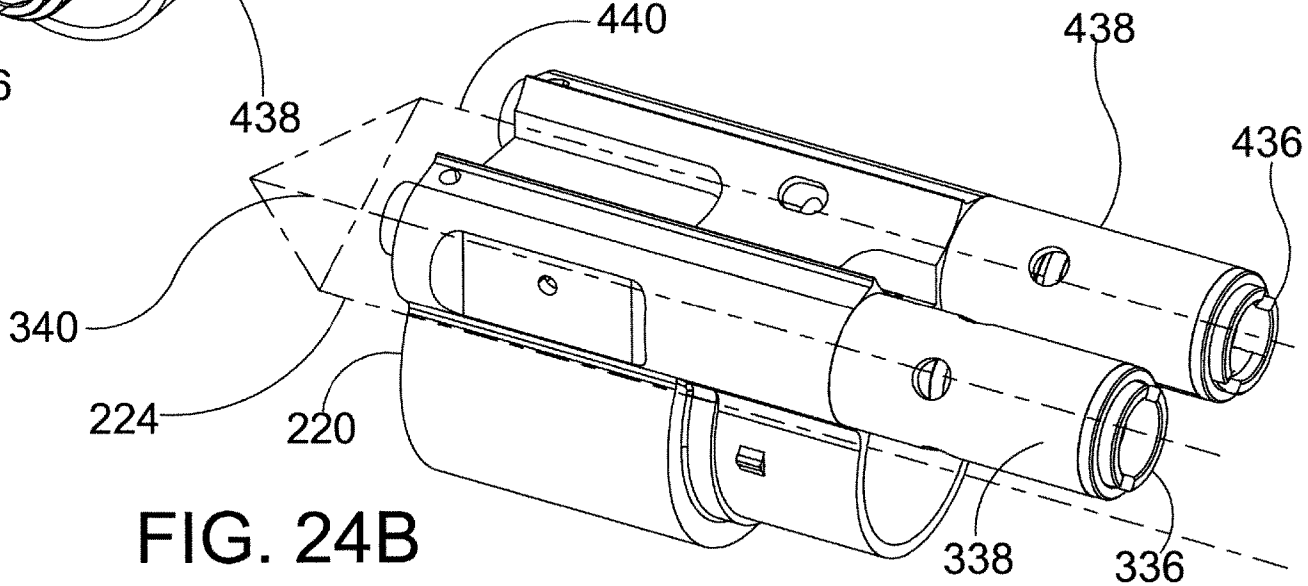
FIG. 24B is an isometric view showing an assembly.
Figures 25A, 25B, 25C:
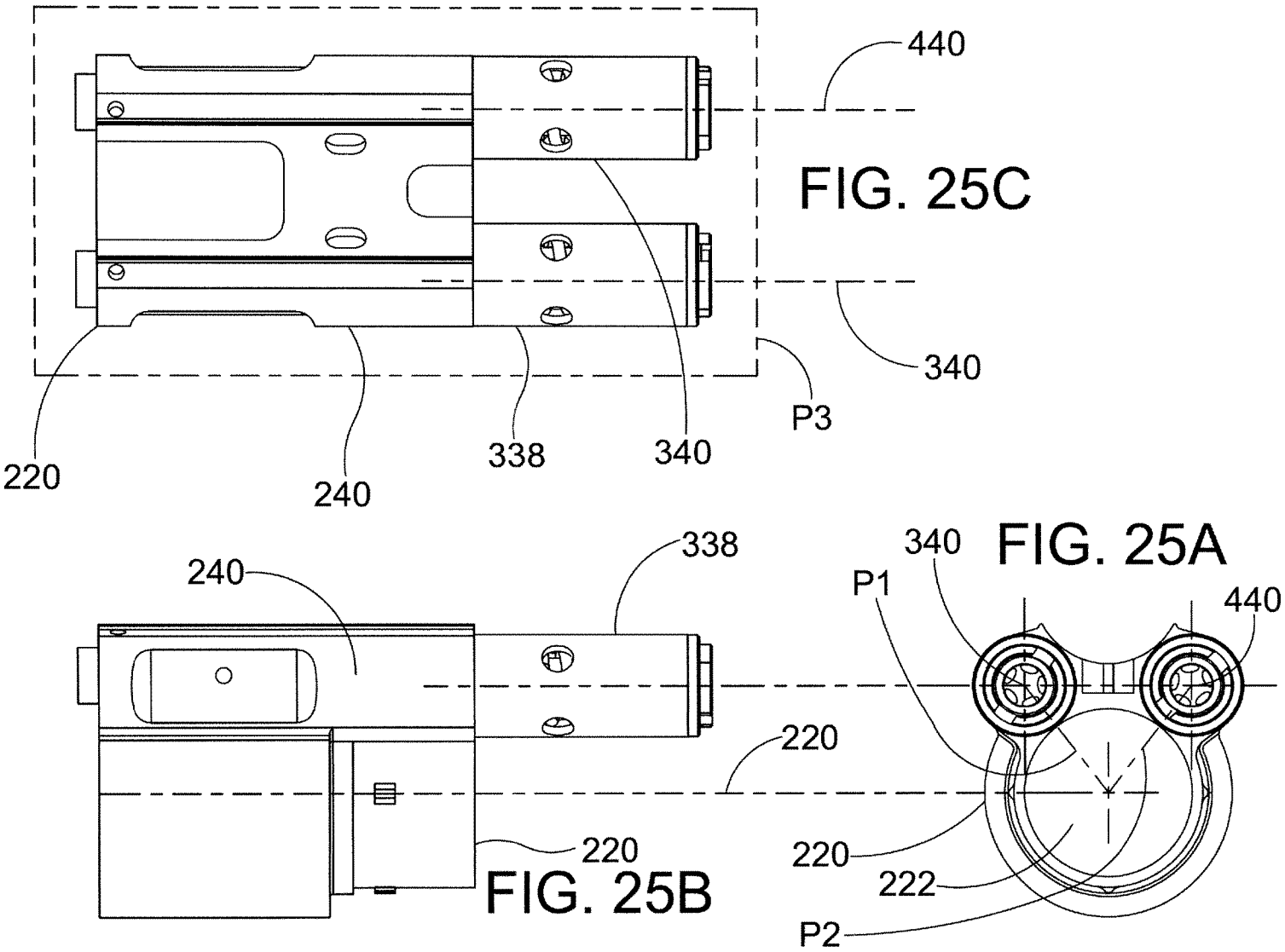
FIG. 25A is a front view showing an assembly.
FIG. 25B is a side view showing an assembly.
FIG. 25C is a top view showing an assembly.

FIG. 20G is an enlarged cross-sectional view further illustrating the spring loaded plunger assembly 50 shown in FIG. 20F. With reference to FIG. 20G, it will be appreciated that the second coil spring 84 is disposed inside a spring lumen 60 defined by the first coil spring 82. One end of the stock rod 64 may threadingly engage a female thread of the plunger housing 54.

Figure 4:
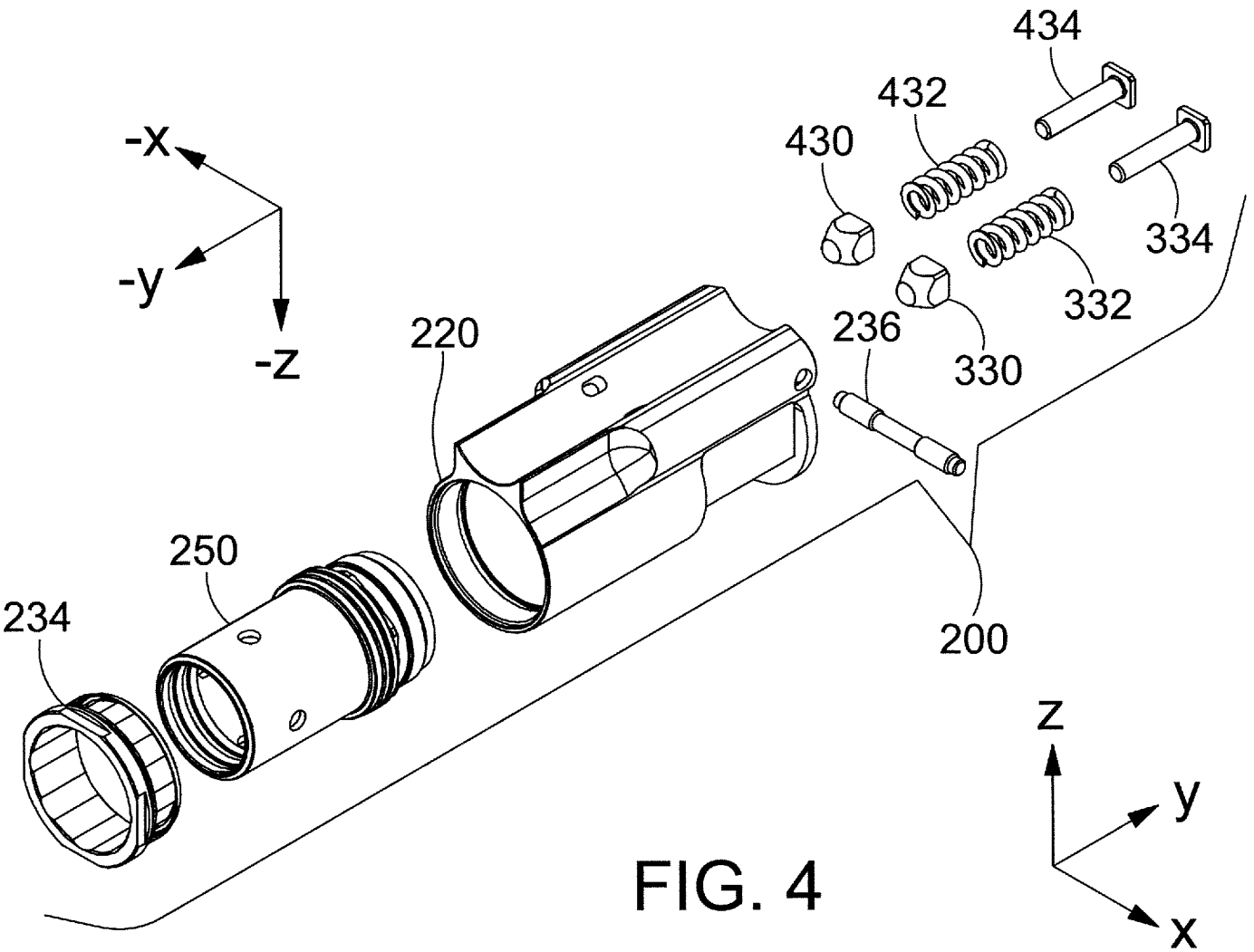
FIG. 4 is a perspective, exploded view of a gas block assembly in accordance with an embodiment described in the detailed description.
Figure 5:
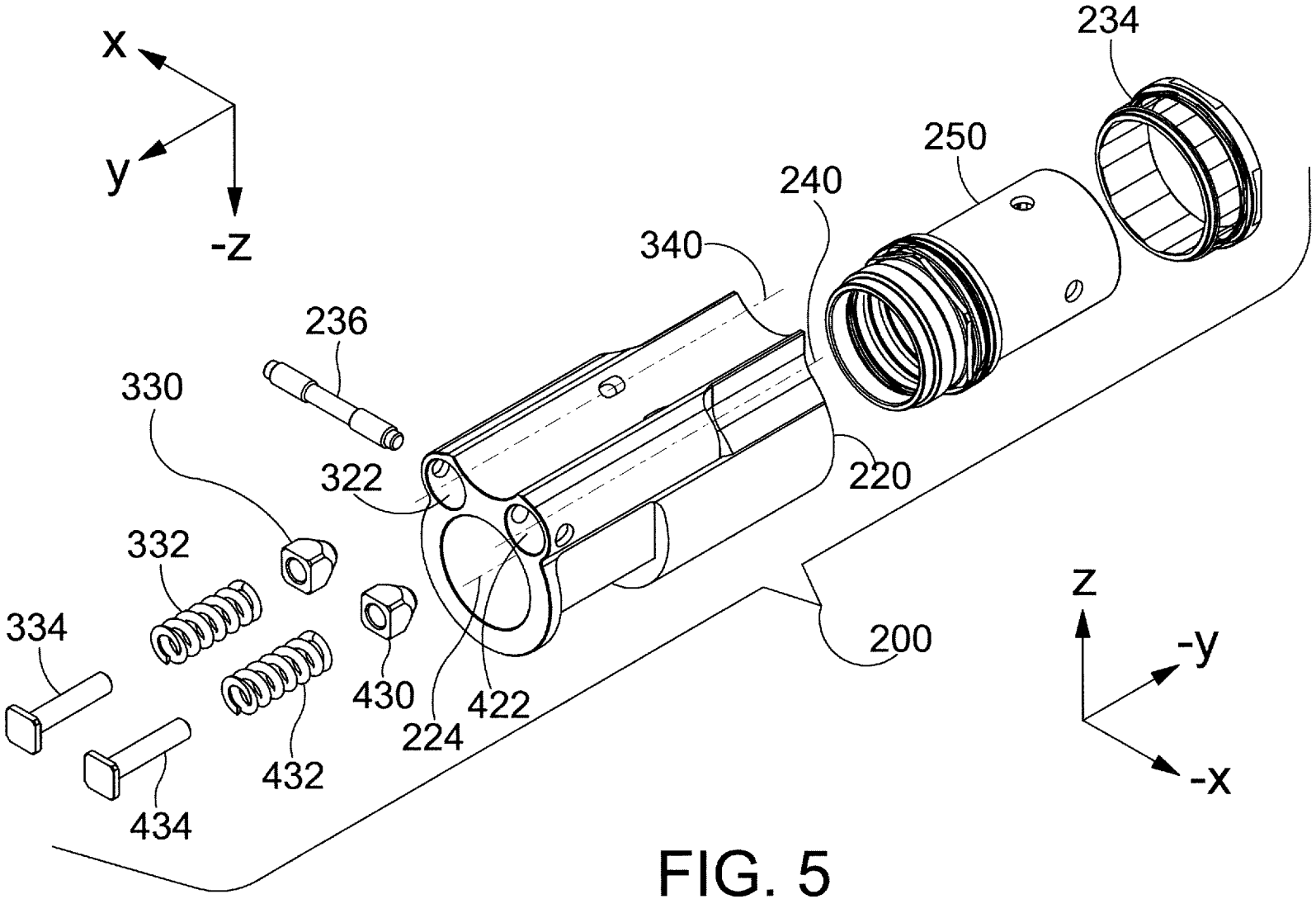
FIG. 5 is an additional perspective, exploded view of the gas block assembly shown in FIG. 4.
Figures 6A, 6B:
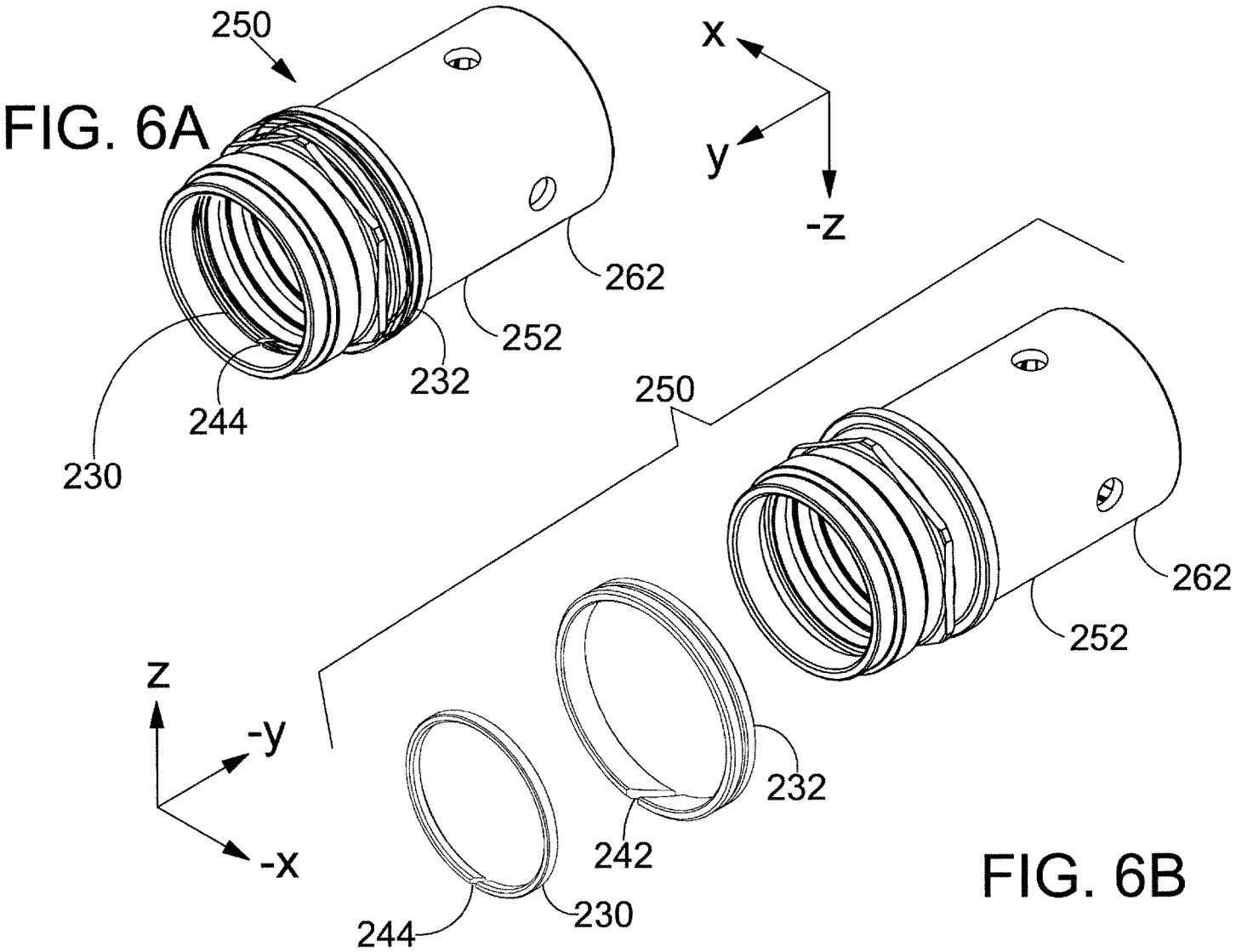
FIG. 6A is a perspective view of a sleeve assembly in accordance with an embodiment described in the detailed description.
FIG. 6B is a perspective, exploded view of the sleeve assembly shown in FIG. 6A.
Figure 7:
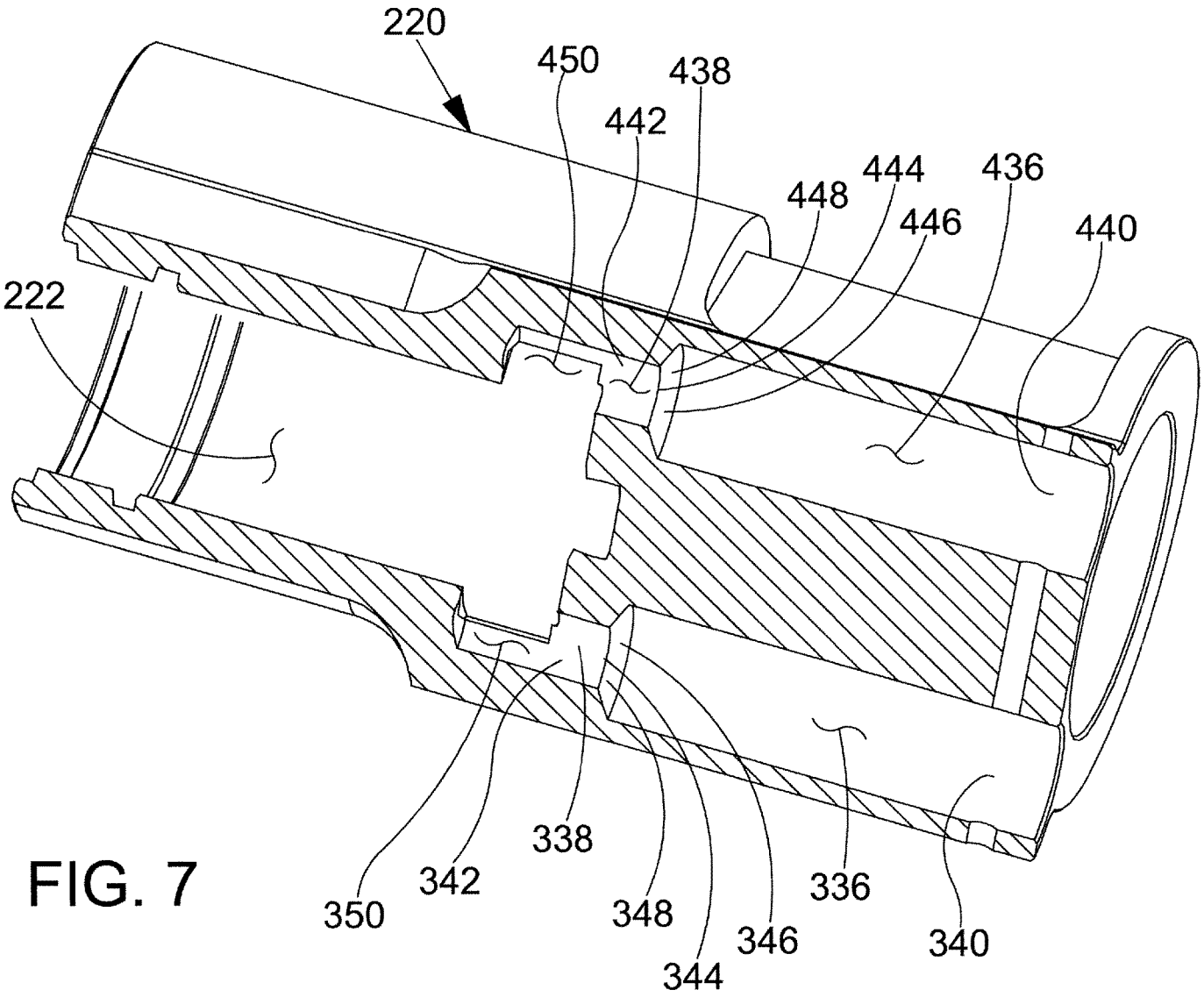
FIG. 7 is a cross-sectioned perspective view of a gas block in accordance with an embodiment described in the detailed description.
Figure 8B:
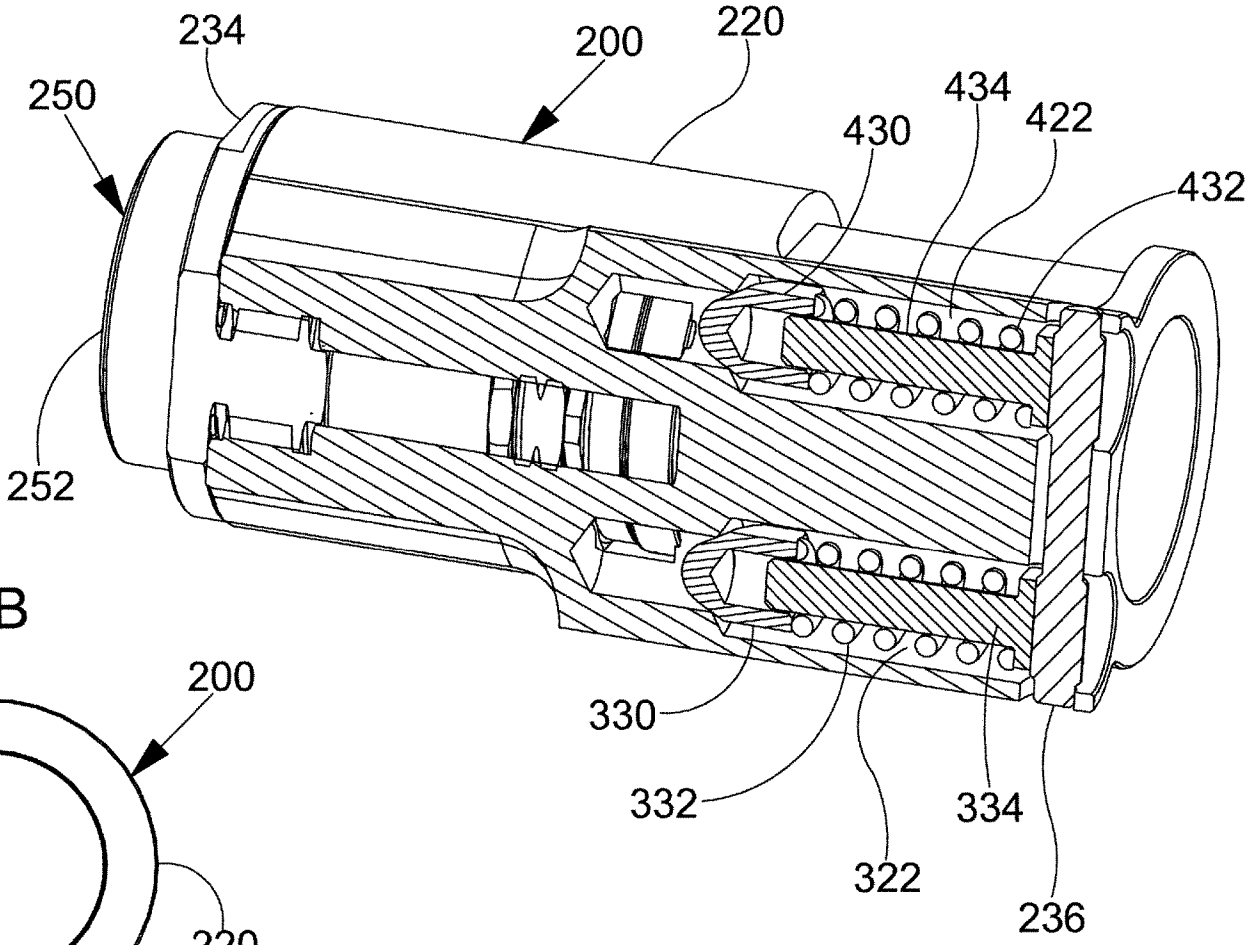
FIG. 8B is a cross-sectioned perspective view of a gas block assembly in accordance with an embodiment described in the detailed description.
Figure 8A:
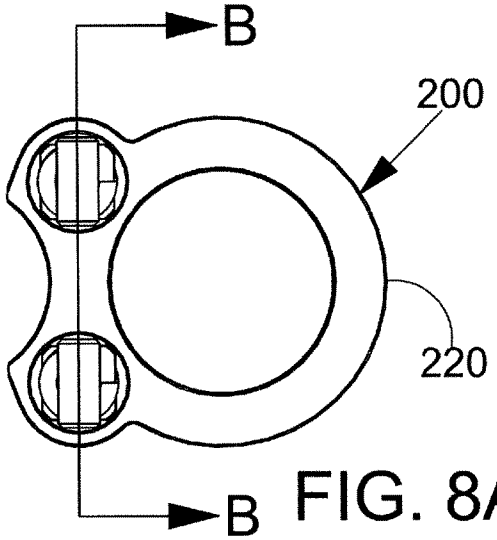
FIG. 8A is an end view showing a gas block assembly and a section line.
Figure 9:
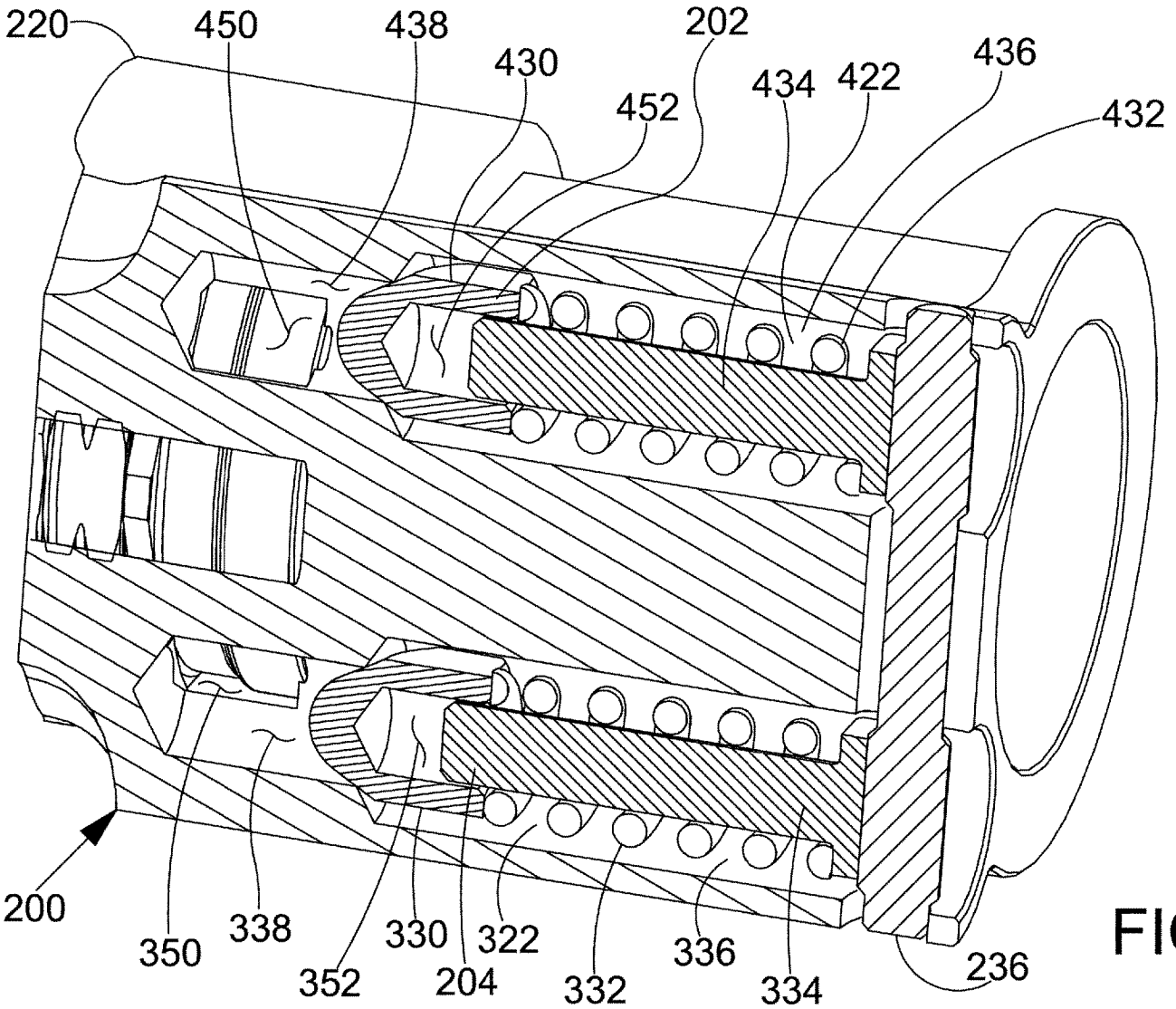
FIG. 9 is an enlarged cross-sectioned perspective view further illustrating a portion of the gas block assembly shown in FIG. 8B.
Figure 10A:
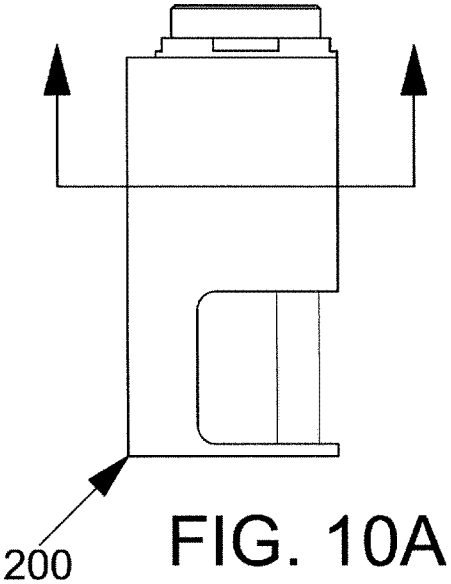
FIG. 10A is a side view showing a gas block assembly and a section line.
Figure 10B:
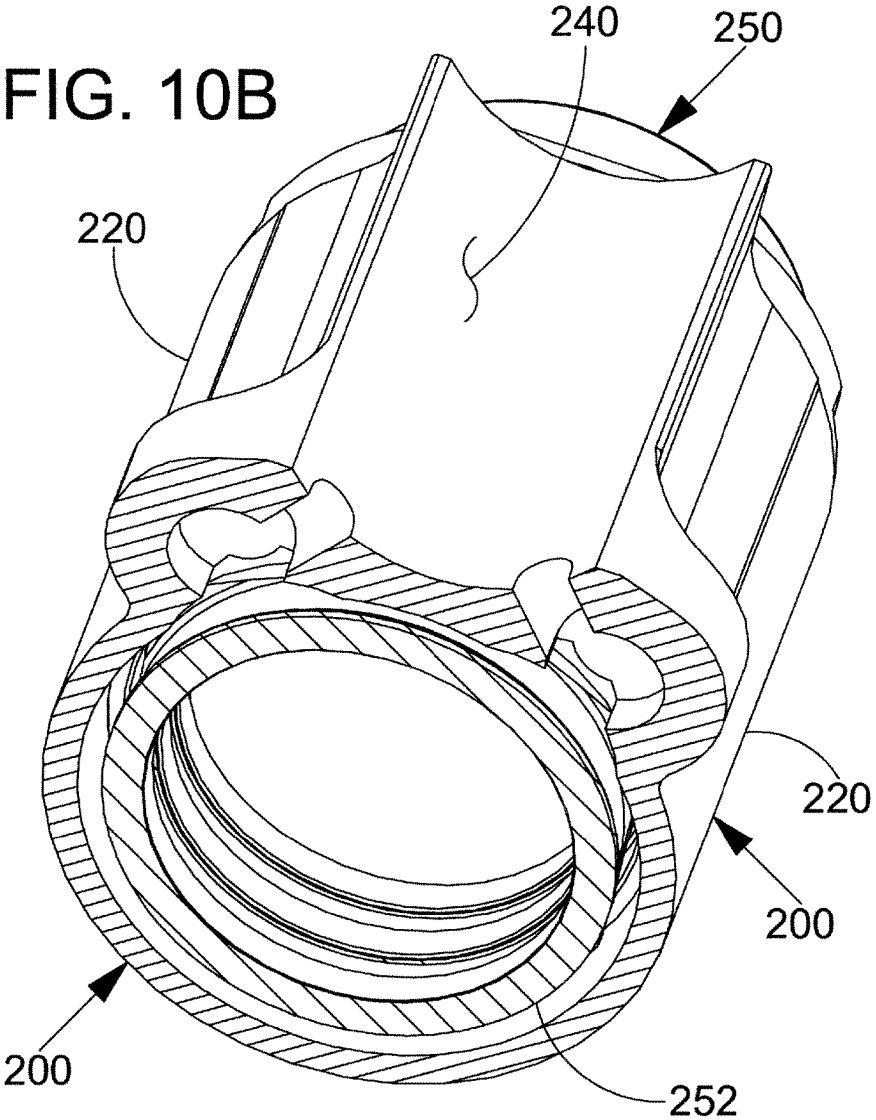
FIG. 10B is a cross-sectioned perspective view of a gas block assembly in accordance with an embodiment described in the detailed description.
Figure 11:
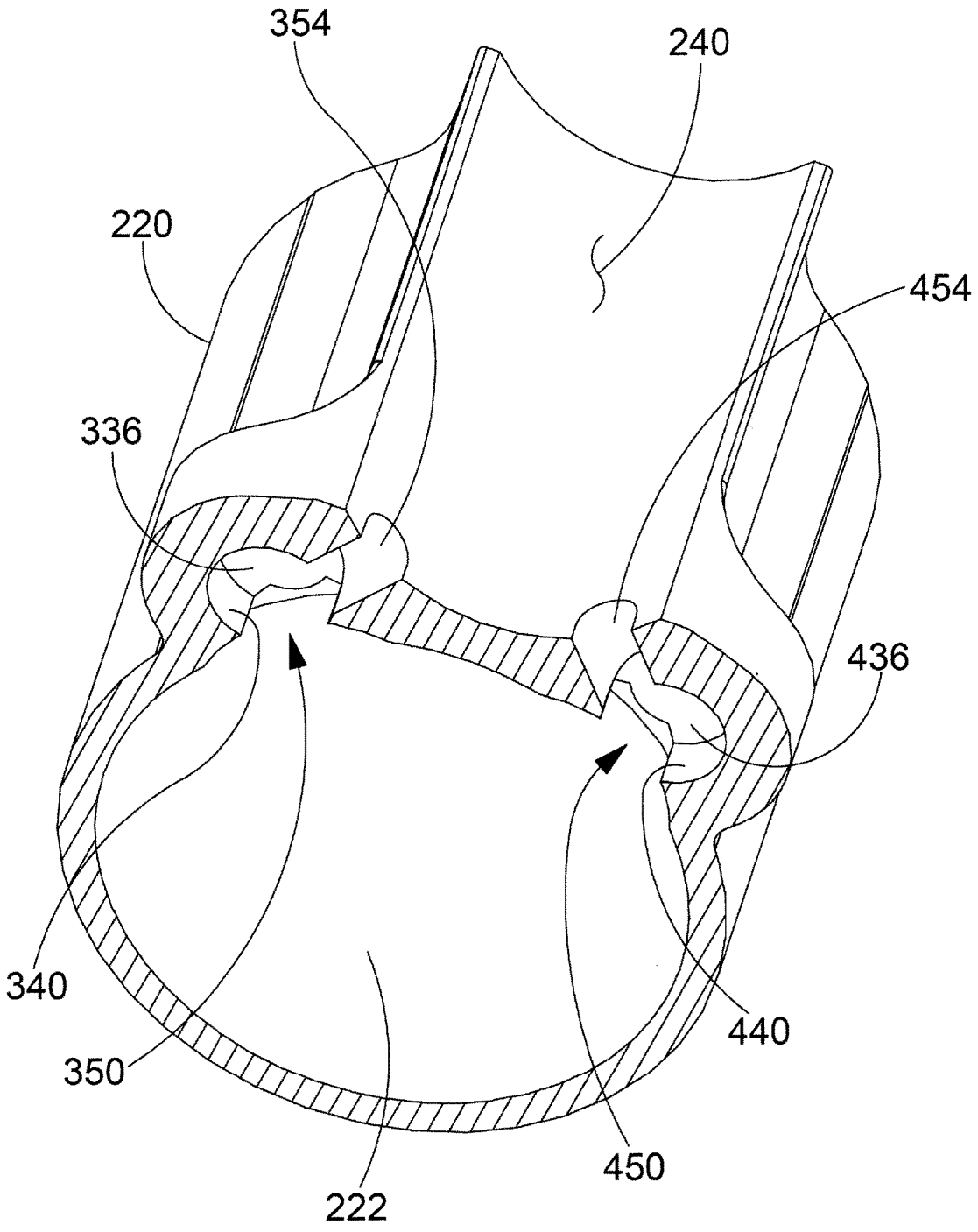
FIG. 11 is a cross-sectioned perspective view of a gas block in accordance with an embodiment described in the detailed description.

Referring, for example, to FIGS. 4 and 5, an upward direction Z and a downward or lower direction −Z are illustrated using arrows labeled "Z" and "−Z," respectively. A forward direction Y and a rearward direction −Y are illustrated using arrows labeled "Y" and "−Y," respectively. "Forward" is the shooting direction of the shotgun. A starboard direction X and a port direction −X are illustrated using arrows labeled "X" and "−X," respectively. The directions illustrated using these arrows are applicable to the apparatus shown and discussed throughout this application. The port direction may also be referred to as the portward direction. In one or more embodiments, the upward direction is generally opposite the downward direction. In one or more embodiments, the upward direction and the downward direction are both generally orthogonal to an XY plane defined by the forward direction and the starboard direction. In one or more embodiments, the forward direction is generally opposite the rearward direction. In one or more embodiments, the forward direction and the rearward direction are both generally orthogonal to a ZY plane defined by the upward direction and the starboard direction. In one or more embodiments, the starboard direction is generally opposite the port direction. In one or more embodiments, starboard direction and the port direction are both generally orthogonal to a ZX plane defined by the upward direction and the forward direction. Various direction-indicating terms are used herein as a convenient way to discuss the objects shown in the figures. It will be appreciated that many direction indicating terms are related to the instant orientation of the object being described. It will also be appreciated that the objects described herein may assume various orientations without deviating from the spirit and scope of this detailed description. Accordingly, direction-indicating terms such as "upwardly," "downwardly," "forwardly," "backwardly," "portwardly," and "starboardly," should not be interpreted to limit the scope of the invention recited in the attached claims.

The following United States patents are hereby incorporated by reference herein: U.S. Pat. Nos. 4,601,122, 4,702,146, 4,856,217, 4,872,392, 4,901,623, 5,429,034, 5,867,928, 5,872,323, 5,918,401, 5,959,234, 6,347,569, 6,382,073, 6,470,614, 6,508,160, 6,564,691, 6,619,592, 7,467,581, 7,775,149, 7,946,214, 7,963,061, 8,056,280, 8,065,949, 8,079,168, 8,109,194, 8,230,632, 8,245,625, 8,250,964, 8,312,656, 8,443,712, 8,528,458, 8,850,731, 8,939,060, 9,097,475, 9,212,856, and 9,383,149.

The above references in all sections of this application are herein incorporated by references in their entirety for all purposes. Components illustrated in such patents may be utilized with embodiments herein. Incorporation by reference is discussed, for example, in MPEP section 2163.07(B).

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

What is claimed is:

1. A semiautomatic shotgun, comprising:

a receiver defining a receiver interior;

a barrel attached to a forward portion of the receiver, the barrel having a breech end and a muzzle end, the barrel having a barrel wall extending in a forward direction from the breech end to the muzzle end and extending in a rearward direction from the muzzle end to the breech end, the barrel wall defining a barrel bore extending along a barrel axis of the barrel, the barrel wall defining a firing chamber fluidly communicating with the barrel bore, the firing chamber being dimensioned and configured to receive a shell;

a breech block slidably received in the receiver interior, the breech block being movable between a forward position in which the breech block engages the breech end of the barrel for firing a chambered shell, and a rearward position in which the breech block is positioned rearward of the breech end of the barrel for discharging a spent shell;

a magazine tube attached to a forward portion of the receiver below the barrel, the magazine tube having a rearward end and a forward end, the magazine tube having a magazine wall extending in the forward direction from the rearward end to the forward end and extending in the rearward direction from the forward end to the rearward end, the magazine wall defining a magazine tube bore extending along a magazine tube axis of the magazine tube;

a sleeve comprising a sleeve wall, the sleeve wall having an outer surface and an inner surface, the inner surface of the sleeve wall defining a sleeve lumen, the sleeve being positioned so that the sleeve wall encircles the magazine tube with the magazine tube extending through the sleeve lumen;

the sleeve having a rearward end and a forward end, the sleeve wall extending in the forward direction from the rearward end to the forward end and extending in the rearward direction from the forward end to the rearward end;

a first ring disposed between an inner surface of the sleeve and an outer surface of the magazine tube, the first ring defining a slit;

a gas block defining a block bore, the magazine tube extending through the block bore defined by the gas block;

the sleeve extending into the block bore defined by a gas block, a portion of the sleeve being disposed between an outer surface of the magazine tube and inner surface of the gas block;

a second ring disposed between an outer surface of the sleeve and an inner surface of the gas block, the second ring defining a slot;

the magazine tube, the sleeve, and the gas block cooperating to define an annular volume;

the gas block defining a channel and an upward facing opening fluidly communicating with the channel, the barrel extending into the channel;

the gas block having a rearward end and a forward end, the gas block having a body extending in the forward direction from the rearward end to the forward end and extending in the rearward direction from the forward end to the rearward end, the body of the gas block defining a starboard regulator cavity and a port regulator cavity;

the starboard regulator cavity comprising a forward starboard bore, a rearward starboard bore and a starboard valve seat disposed between the forward starboard bore and the rearward starboard bore, the forward starboard bore extending in the forward direction away from the starboard valve seat, the starboard rearward bore extending in the rearward direction away from the starboard valve seat, the forward starboard bore being defined by a forward bore surface, the rearward starboard bore being defined by a rearward bore surface, the starboard valve seat comprising a starboard valve seat surface extending between the forward starboard bore surface and the starboard rearward bore surface, the forward starboard bore having a first diameter, the starboard rearward bore having a second diameter, the second diameter being greater than the first diameter, the forward bore surface meeting the starboard valve seat surface at an edge, a seating surface of a starboard valve member being biased to seat against the edge by a starboard spring, a starboard guide extending through a starboard lumen defined by the starboard spring and into a starboard pocket defined by the starboard valve member;

the forward starboard bore of the starboard regulator cavity fluidly communicating with the annular volume via a starboard aperture; and the forward starboard bore of the starboard regulator cavity fluidly communicating with the barrel bore via a starboard passageway defined by the gas block and a starboard hole defined by the barrel.

2. The semiautomatic shotgun of claim 1, wherein, upon firing a shell, combustion gasses within the barrel enter the annular volume via the starboard hole and the port hole to move the sleeve and a slider rearward for cycling a mechanism or breech block disposed in the receiver interior.

3. The semiautomatic shotgun of claim 1, further comprising:

a slider comprising an slider wall, the slider wall having an outer surface and an inner surface, the inner surface defining a slider lumen, the slider being positioned so that the slider wall encircles the magazine tube and the magazine tube extends through the slider lumen, the slider having a rearward end and a forward end, the slider wall extending in the forward direction from the rearward end to the forward end and extending in the rearward direction from the forward end to the rearward end;

a starboard leg having a forward end and a rearward end, a portion of the starboard leg proximate the forward end being fixed to the slider, a portion of the starboard leg proximate the rearward end engaging a mechanism or breech block disposed inside the receiver interior, a port leg having a forward end and a rearward end, a portion of the port leg proximate the forward end being fixed to the slider, a portion of the port leg proximate the rearward end engaging the mechanism or breech block disposed inside the receiver interior.

4. The semiautomatic shotgun of claim 1, wherein the port regulator cavity comprises a forward port bore, a rearward port bore and a port valve seat disposed between the forward port bore and the rearward port bore, the forward port bore extending in the forward direction away from the port valve seat, the port rearward bore extending in the rearward direction away from the port valve seat, the forward port bore being defined by a forward bore surface, the rearward port bore being defined by a rearward bore surface, the port valve seat comprising a port valve seat surface extending between the forward port bore surface and the port rearward bore surface, the forward port bore having a first diameter, the port rearward bore having a second diameter, the second diameter being greater than the first diameter, the forward bore surface meeting the port valve seat surface at a port edge, a seating surface of a port valve member being biased to seat against the port edge by a port spring, a port guide extending through a port lumen defined by the port spring and into a port pocket defined by the port valve member, the forward port bore of the port regulator cavity fluidly communicating with the annular volume via a port aperture, and the forward port bore of the port regulator cavity fluidly communicating with the barrel bore via a port passageway defined by the gas block and a port hole defined by the barrel.

5. The semiautomatic shotgun of claim 1, further including a starboard pressure regulator associated with the starboard pressure regulator cavity and a port pressure regulator associated with the port pressure regulator cavity, wherein the starboard pressure regulator and the port pressure regulator allow combustion gases to escape when an applied pressure is greater than a preselected relief pressure.

6. The semiautomatic shotgun of claim 1, wherein:

the semiautomatic shotgun comprises a starboard pressure regulator associated with the starboard pressure regulator cavity and a port pressure regulator associated with the port pressure regulator cavity;

the starboard pressure regulator allows combustion gases to escape when an applied pressure is greater than a first relief pressure;

the port pressure regulator allows combustion gases to escape when the applied pressure is greater than a second relief pressure; and the first relief pressure is different from the second relief pressure.

7. A semiautomatic shotgun, comprising:

a receiver defining a receiver interior;

a barrel attached to a forward portion of the receiver, the barrel having a barrel wall extending forwardly from the receiver;

a magazine tube attached to a forward portion of the receiver below the barrel, the magazine tube having a magazine wall extending in the forward direction from the receiver, the magazine wall defining a magazine tube bore extending along a magazine tube axis of the magazine tube;

a sleeve comprising a sleeve wall, the sleeve wall having an outer surface and an inner surface, the inner surface of the sleeve wall defining a sleeve lumen, the sleeve being positioned so that the sleeve wall encircles the magazine tube with the magazine tube extending through the sleeve lumen;

a gas block defining a block bore, the magazine tube extending through the block bore defined by the gas block;

the sleeve extending into the block bore defined by the gas block, a portion of the sleeve being disposed between an outer surface of the magazine tube and inner surface of the gas block;

the magazine tube, the sleeve, and the gas block cooperating to define an annular volume;

the gas block defining a channel and an upward facing opening fluidly communicating with the channel, the barrel extending into the channel;

the body of the gas block defining a starboard regulator cavity and a port regulator cavity;

each cavity comprising a forward bore, a rearward bore and a valve seat disposed between the forward bore and the rearward bore, the forward bore extending in the forward direction away from the valve seat, the rearward bore extending in the rearward direction away from the valve seat, the forward bore being defined by a forward bore surface, the rearward bore being defined by a rearward bore surface, the valve seat comprising a valve seat surface extending between the forward bore surface and the rearward bore surface, the forward bore having a first diameter, the rearward bore having a second diameter, the second diameter being greater than the first diameter, the forward bore surface meeting the valve seat surface at an edge;

the forward bore of each regulator cavity fluidly communicating with the annular volume via an aperture; and the forward bore of each regulator cavity fluidly communicating with the barrel bore via a passageway defined by the gas block and a hole defined by the barrel.

8. The semiautomatic shotgun of claim 7, wherein, upon firing a shell, combustion gasses within the barrel enter the annular volume via a starboard hole and a port hole to move the sleeve and a slider rearward for cycling a breech block disposed in the receiver interior.

9. The semiautomatic shotgun of claim 7, further comprising:

a slider comprising an slider wall, the slider wall having an outer surface and an inner surface, the inner surface defining a slider lumen, the slider being positioned so that the slider wall encircles the magazine tube and the magazine tube extends through the slider lumen, the slider having a rearward end and a forward end, the slider wall extending in the forward direction from the rearward end to the forward end and extending in the rearward direction from the forward end to the rearward end;

a starboard leg having a forward end and a rearward end, a portion of the starboard leg proximate the forward end being fixed to the slider, a portion of the starboard leg proximate the rearward end engaging a mechanism or breech block disposed inside the receiver interior, a port leg having a forward end and a rearward end, a portion of the port leg proximate the forward end being fixed to the slider, a portion of the port leg proximate the rearward end engaging the mechanism or breech block disposed inside the receiver interior.

10. The semiautomatic shotgun of claim 7, further comprising a port valve member, a seating surface of the port valve member being biased to seat against the edge by a port spring, a port guide extending through a port lumen defined by the port spring and into a port pocket defined by the port valve member, the forward bore of the port regulator cavity fluidly communicating with the annular volume via a port aperture, and the forward bore of the port regulator cavity fluidly communicating with the barrel bore via a port passageway defined by the gas block and a port hole defined by the barrel.

11. The semiautomatic shotgun of claim 7, wherein the barrel has a barrel wall extending in a forward direction from the breech end to the muzzle end and extending in a rearward direction from the muzzle end to the breech end, the barrel wall defining a barrel bore extending along a barrel axis of the barrel, the barrel wall defining a firing chamber fluidly communicating with the barrel bore, the firing chamber being dimensioned and configured to receiving a shell.

12. The semiautomatic shotgun of claim 7, further comprising a breech block slidably received in the receiver interior, the breech block being movable between a forward position in which the breech block engages the breech end of the barrel for firing a chambered shell, and a rearward position in which the breech block is positioned rearward of the breech end of the barrel for discharging a spent shell.

13. The semiautomatic shotgun of claim 12, further comprising a shock absorption means positioned rearward of the breech block.

14. The semiautomatic shotgun of claim 13, wherein the shock absorption means comprises a plurality of Belleville washers and a plunger engaged with the plurality of Belleville washers.

15. The semiautomatic shotgun of claim 13, wherein the shock absorption means comprises a double spring assembly, one spring coaxially placed in a second spring.

16. The semiautomatic shotgun of claim 7, further including a starboard pressure regulator associated with the starboard pressure regulator cavity and a port pressure regulator associated with the port pressure regulator cavity, wherein the starboard pressure regulator and the port pressure regulator allow combustion gases to escape when an applied pressure is greater than a preselected relief pressure.

17. The semiautomatic shotgun of claim 7, wherein:

the semiautomatic shotgun comprises a starboard pressure regulator associated with the starboard pressure regulator cavity and a port pressure regulator associated with the port pressure regulator cavity;

the starboard pressure regulator allows combustion gases to escape when an applied pressure is greater than a first relief pressure;

the port pressure regulator allows combustion gases to escape when the applied pressure is greater than a second relief pressure; and the first relief pressure is different from the second relief pressure.

* * * * *